US008249470B2

(12) United States Patent
Nishimura et al.

(10) Patent No.: US 8,249,470 B2
(45) Date of Patent: Aug. 21, 2012

(54) POWDER MATERIAL RECOVERY CONTAINER, AND POWDER MATERIAL RECOVERY DEVICE AND IMAGE FORMING DEVICE USING POWDER MATERIAL RECOVERY CONTAINER

(75) Inventors: Koji Nishimura, Kanagawa (JP); Kanji Watanabe, Kanagawa (JP); Hideaki Oike, Kanagawa (JP); Kazuhiro Yoshihara, Kanagawa (JP); Tsuneo Fukuzawa, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 376 days.

(21) Appl. No.: 12/554,474

(22) Filed: Sep. 4, 2009

(65) Prior Publication Data

US 2010/0111582 A1 May 6, 2010

(30) Foreign Application Priority Data

Oct. 31, 2008 (JP) ..... P2008-282172

(51) Int. Cl.
*G03G 21/12* (2006.01)

(52) U.S. Cl. ..... 399/35; 399/120; 399/358; 399/360

(58) Field of Classification Search ..... 399/35, 399/110, 123, 120, 358, 360
See application file for complete search history.

(56) References Cited

U.S. PATENT DOCUMENTS

| | | | | |
|---|---|---|---|---|
| 4,982,230 | A * | 1/1991 | Ogura et al. | 399/35 |
| 7,167,671 | B2 * | 1/2007 | Serizawa et al. | 399/360 |
| 2004/0052560 | A1 * | 3/2004 | Ishii et al. | 399/360 |
| 2011/0103856 | A1 * | 5/2011 | Sato et al. | 399/360 |

FOREIGN PATENT DOCUMENTS

| | | |
|---|---|---|
| JP | 2002-148884 | 5/2002 |
| JP | 2007-163764 | 6/2007 |
| JP | 2009-122238 | 6/2009 |

OTHER PUBLICATIONS

Machine Translation of JP-2009-122238.*

* cited by examiner

*Primary Examiner* — David Gray
*Assistant Examiner* — G.M. Hyder
(74) *Attorney, Agent, or Firm* — Morgan, Lewis & Bockius LLP

(57) ABSTRACT

A powder material recovery container includes: a container main body that accommodates a powder material; a conveying member that is arranged with a part existing at least in an intermediate position of a dropping movement of the powder material and rotates to convey it, the conveying member having a conveying part that conveys the powder material around a central line of rotation; and a moving passage surface arranged in a lower part of the part existing at least in the intermediate position, and opposed to one part of the conveying member and move it by a conveying force, wherein the moving passage surface has upper end parts of side surfaces opposed to each other with respect to the central line that are formed with relatively different heights, and the relatively lower upper end part is formed with height not higher than a height of the central line.

22 Claims, 16 Drawing Sheets

POWDER MATERIAL RECOVERY CONTAINER, AND POWDER MATERIAL RECOVERY DEVICE AND IMAGE FORMING DEVICE USING POWDER MATERIAL RECOVERY CONTAINER

CROSS-REFERENCE TO RELATED APPLICATIONS

This application is based on and claims priority under 35 USC 119 from Japanese Patent Application No. 2008-282172 filed Oct. 31, 2008.

BACKGROUND

1. Technical Field

The present invention relates to a powder material recovery container and a powder material recovery device and an image forming device using the powder material recovery container.

2. Related Art

There is a recovery container for accommodating a powder material such as a developer as an object to be recovered or a powder material recovery device using the recovery container.

SUMMARY

According to an aspect of the invention, there is provided a powder material recovery container comprising a container main body, a conveying member and a moving passage surface. The container main body accommodates a powder material which dropped, in the container main body. The conveying member is arranged with a part existing at least in an intermediate position of a dropping movement of the powder material in the container main body and rotates to convey the powder material. The conveying member has a conveying part that conveys the powder material around a central line of rotation. The moving passage surface is arranged in a lower part of the part existing at least in the intermediate position of the dropping movement of the powder material of the conveying member in the container main body, and opposed to one part of the conveying member to receive a part of the dropping powder material and move the part of the powder material by a conveying force of the conveying member. The moving passage surface has upper end parts of side surfaces opposed to each other with respect to the central line of rotation of the conveying member that are formed with relatively different heights, and the relatively lower upper end part of the side surface is formed with height not higher than a height of the central line of rotation.

BRIEF DESCRIPTION OF THE DRAWINGS

Exemplary embodiments of the invention will be described in detail based on the following figures, wherein.

DETAILED DESCRIPTION

Now, a best mode (refer it simply to as an "exemplary embodiment") for carrying out the present invention will be described below by referring to the attached drawings.

First Exemplary Embodiment

Figure 1A:
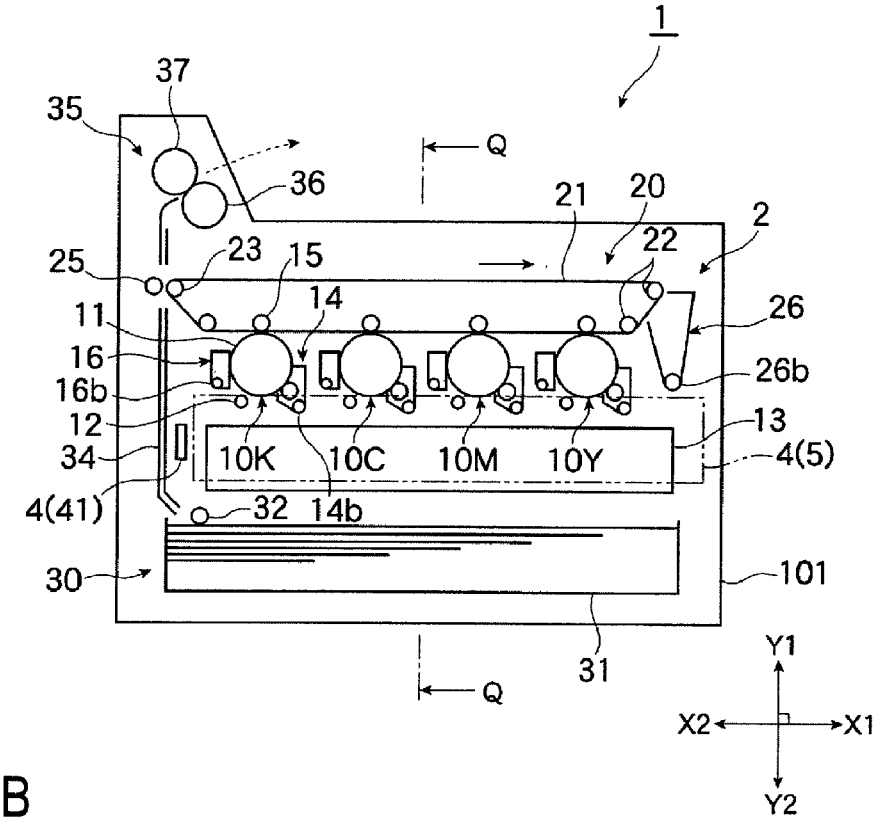
FIG. 1A is an explanatory view when an image forming device (and a developer recovery device) according to a first exemplary embodiment is seen from a front surface side thereof.
Figure 1B:
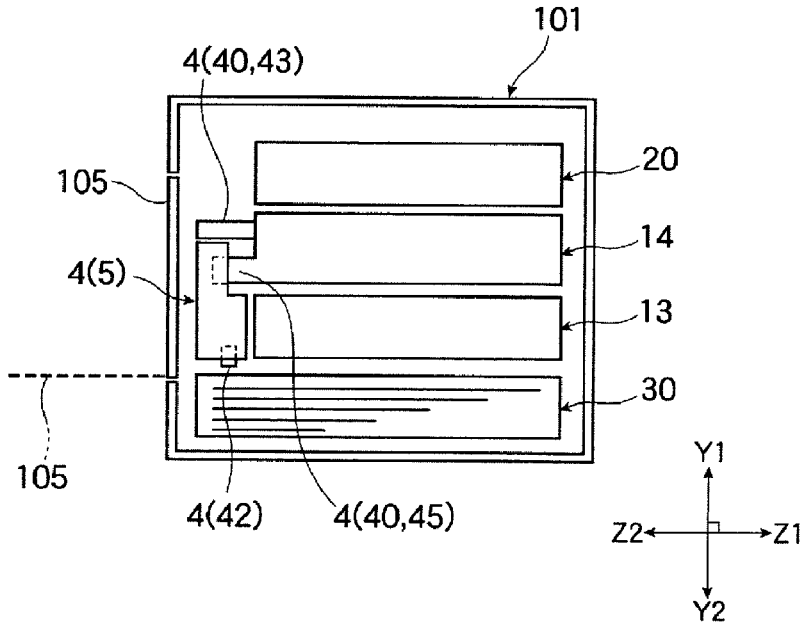
FIG. 1B is a partly sectional explanatory view along a line Q-Q in FIG. 1A.
Figure 2:
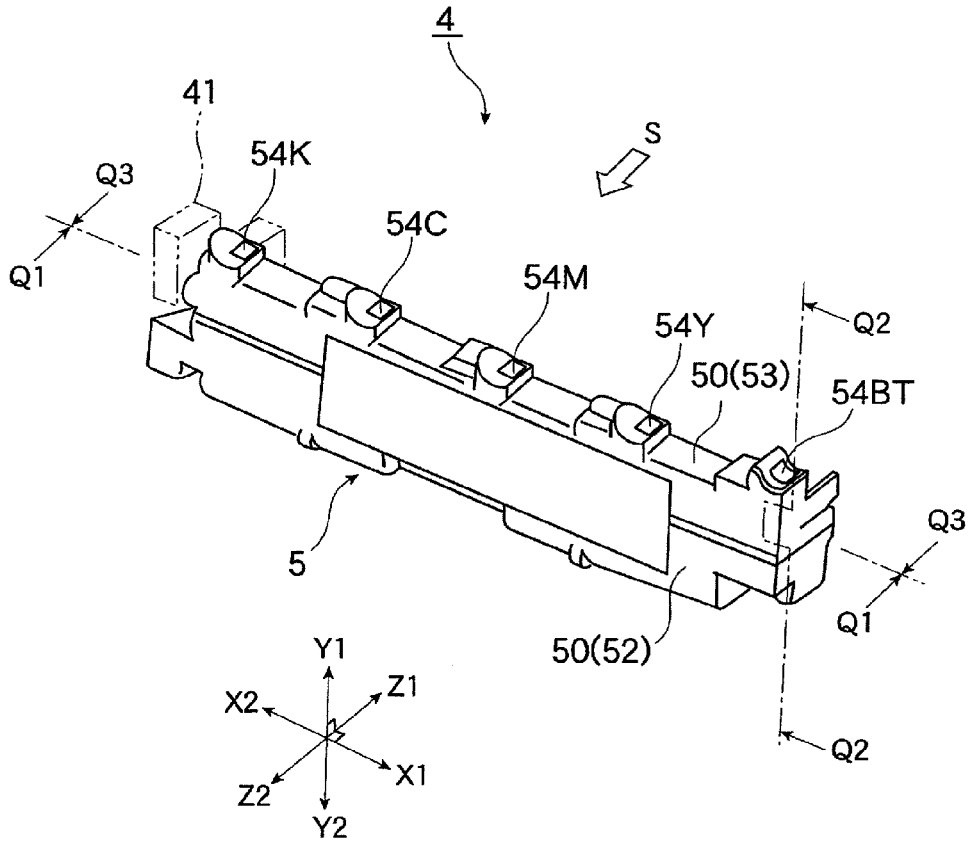
FIG. 2 is a perspective view (a front surface side) showing a recovery container of a developer used in the image forming device shown in FIG. 1A.
Figure 3:
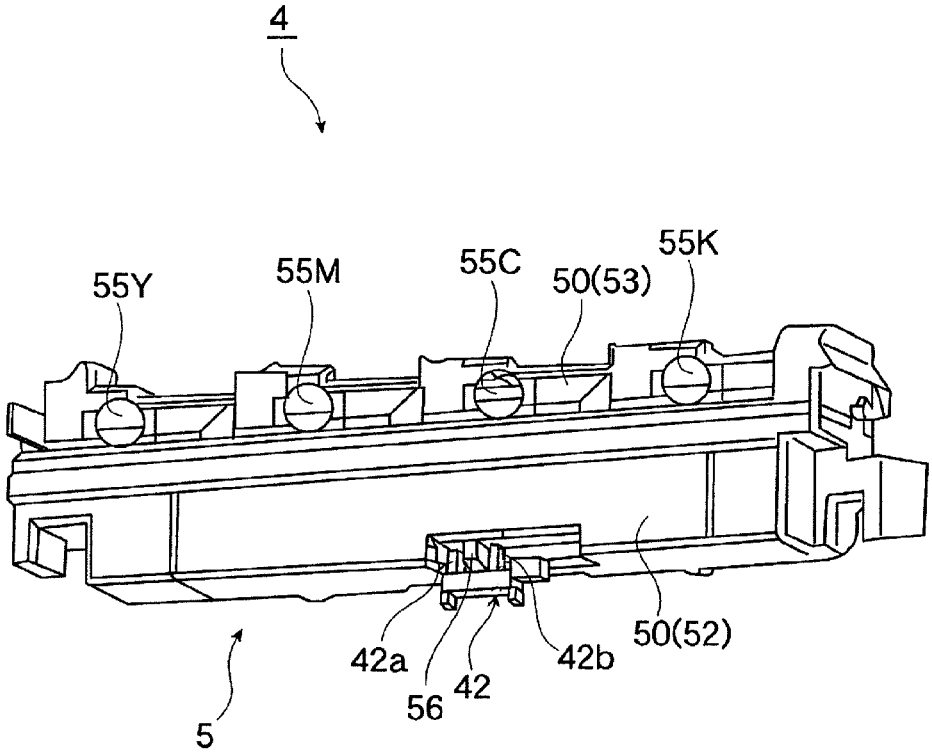
FIG. 3 is a perspective view (a rear surface side) when the recovery container shown in FIG. 2 is seen from a direction of an arrow mark S.

FIGS. 1A to 3 show an image forming device according to a first exemplary embodiment to which a powder material recovery container of the present invention is applied. FIGS. 1A and 1B show an entire part of the image forming device 1 respectively from its front surface side and its side surface side. FIGS. 2 and 3 show an entire part of a powder material recovery container 5 (and a developer recovery device 4) thereof.

As shown in FIG. 1A, in the image forming device 1, in an inner space of a casing 101 formed with a support member, an outer cover and the like, are mainly provided an image creating device 2, a sheet feeder 30 and a fixing device 35. The image creating device 2 forms a toner image composed of toner as a developer and transfers the toner image to a sheet P. The sheet feeder 30 accommodates and conveys the sheet P used in the image creating device 2. The fixing device 35 fixes the toner image transferred in the image creating device 2 in the sheet P.

The image creating device 2 includes plural image creating units 10 and an intermediate transfer unit 20. The image creating units 10 forms the toner images of respective color components by using a known electro-photographic system.

The intermediate transfer unit 20 temporarily holds and conveys the toner images of the respective color components formed by the image creating units 10 and then transfers the toner images to the sheet P. In the first exemplary embodiment, as the plural image creating units 10, four image creating units are used in which the toner images of the color components of yellow (Y), magenta (M), cyan (C) and black (K) respectively are individually formed.

The image creating units 10Y, 10M, 10C and 10K basically have common structures and respectively include photosensitive drums 11 that are rotated and driven in prescribed directions (for instance, counterclockwise in the drawing). These units 10 (Y, M, C, K) are all arranged so that the directions of rotation axes of the photosensitive drums 11 are arranged substantially mutually in parallel at regular intervals.

In each of the image creating units 10 (Y, M, C, K), on the periphery of the photosensitive drum 11, are mainly arranged a charging device 12, an exposure device 13, a developing device 14 (Y, M, C, K), a primary transfer device 15 and a first cleaning device 16. The charging device 12 charges a peripheral surface of an image forming area of the photosensitive drum 11 to a prescribed potential. The exposure device 13 applies light based on image information (a signal) to the surface of the charged photosensitive drum 11 to form an electrostatic latent image having a potential difference (for the respective color components). The developing device 14 (Y, M, C, K) carries out a developing process of transferring and sticking toner of respective colors (Y, M, C, K) to the electrostatic latent image to visualize an image. The primary transfer device 15 transfers the toner image to the intermediate transfer unit 20 (its intermediate transfer belt 21). The first cleaning device 16 removes the toner remaining on the surface of the photosensitive drum 11 after the transfer process.

The exposure device 13 carries out an exposure process on the basis of image information obtained by carrying out a prescribed process by an image processor not shown in the drawing to the image information inputted from an image generating source including a copy reading device, an external connecting device and a recording medium reading device connected to or provided in the image forming device 1. Further, the developing device 14 uses the developer including, for instance, a non-magnetic toner and a magnetic carrier, agitates the developer by an agitating and conveying member rotating in an accommodating part to frictionally charge the toner and convey the toner to a developing roll and supplies the toner to a developing area opposed to the photosensitive drum 11. Further, to the charging device 12, the developing device 14 (it developing roll) and the primary transfer device 15, at the time of forming an image, a charging voltage, a developing voltage and a primary transfer voltage are respectively supplied from a power device not shown in the drawing.

Further, the developing device 14 employs a developer supply system that supplies a new developer G from a developer supply device not shown in the drawing at a prescribed time and what is called a trickle system that an excessive developer Ga exceeding a previously set quantity is allowed to overflow and discharged. The first cleaning device 16 is provided with a cleaning member such as a blade, a rotating brush, etc. that comes into contact with the peripheral surface of the photosensitive drum 11 to remove the developer (mainly, the toner) as a residual of a transfer process and discharges a developer Gb removed by the cleaning member by a conveying member 16*b*.

The intermediate transfer unit 20 mainly includes the endless belt shaped intermediate transfer belt 21, plural support rolls 22 to 24, a secondary transfer roll 25 and a second cleaning device 26. The endless belt shaped intermediate transfer belt 21 passes (primary transfer positions) between the photosensitive drums 11 of the image creating units 10 and the primary transfer devices 15 respectively and rotates in a direction shown by an arrow mark (clockwise in the drawing). The intermediate transfer belt 21 is extended in a desired state and supported on the plural support rolls 22 to 24 so as to freely rotate. The secondary transfer roll 25 comes into contact with a part of the intermediate transfer belt 21 supported by the support roll 23 to rotate. The second cleaning device 26 removes the toner remaining on the surface of the intermediate transfer belt 21 after a transfer process.

When the image is formed, to the support roll 23 and the secondary transfer roll 25, a secondary transfer voltage is applied from the power device not shown in the drawing. The second cleaning device 26 is provided with a cleaning member such as a blade, a rotating brush, or the like that comes into contact with the outer peripheral surface of the intermediate transfer belt 21 to remove the developer (mainly, the toner) as a residual of the transfer process, sheet powder or the like and discharges a developer Gc including the sheet powder removed by the cleaning member by a conveying member 26*b*.

The sheet feeder 30 accommodates plural sheets P having prescribed sizes and kinds used for forming the image in a sheet accommodating member 31 of a tray type or a cassette type in a stacked state and feeds the sheets P accommodated in the sheet accommodating member 31 one by one by a delivery device 32. As for the sheet accommodating member 31, plural sheet accommodating members are provided depending on the form of a use. In FIG. 1A, reference numeral 34 designates a fed sheet conveying path formed between the sheet accommodating member 31 of the sheet feeder 30 and a secondary transfer position (the intermediate transfer belt 21 and the secondary transfer roll 25) and includes plural pairs of sheet conveying rolls and a guide member.

The fixing device 35 is provided with a heating and rotating member 36 in a roll form or a belt form, and a pressing and rotating member 37 in a roll form or a belt form. The heating and rotating member 36 is rotated and driven in a direction shown by an arrow mark and has a surface heated to a prescribed temperature by a heating unit and held. The pressing and rotating member 37 comes into contact with the heating and rotating member 36 under a prescribed pressure substantially along the axial direction of the heating and rotating member 36 to rotate following the heating and rotating member 36.

The image is formed by the image forming device 1 in such a way as described below. Here, a basic image forming operation carried out when a color image formed by using the developer of the four colors, what is called a full-color image is formed on one surface of the sheet P is described as an example.

When the image forming device 1 receives a start command of an image forming operation, initially, in the image creating units 10 (Y, M, C, K) of the image creating device 2, the surfaces of the rotating photosensitive drums 11 are respectively charged to prescribed polarities and potentials by the charging devices 12. The charged photosensitive drums 11 are exposed by the exposure device 13 in accordance with the image information to form the electrostatic latent images having the prescribed potential difference. Subsequently, when the electrostatic latent images respectively formed on the photosensitive drums 11 of the image creating units 10 pass the developing devices 14, the electrostatic latent images are developed by the toner charged to a prescribed polarity that is supplied from the developing rolls thereof to be visualized as toner images. Thus, on the photosensitive drums 11 of the image creating units 10 (Y, M, C, K) respectively, the toner images of the respective color components (Y, M, C, K) are solely formed.

Then, when the toner images respectively formed on the photosensitive drums 11 of the image creating units 10 (Y, M, C, K) are conveyed to the primary transfer positions in accordance with the rotation of the photosensitive drums 11, the toner images are primarily transferred to the intermediate transfer belt 21 of the intermediate transfer unit 20 by the primary transfer devices 15 so as to be sequentially overlapped on the intermediate transfer belt 21. When the multiple toner images transferred to the intermediate transfer belt 21 are conveyed to the secondary transfer position, the multiple toner images are secondarily transferred together to the sheet P conveyed to the secondary transfer position through the fed sheet conveying path 34 from the sheet feeder 30 by the secondary transfer roll 25 to this timing. When the primary transfer process and the secondary transfer process are finished, in the image creating units 10, the peripheral surfaces of the photosensitive drums 11 after the primary transfer process are respectively cleaned by the first cleaning devices 16. In the intermediate transfer unit 20, the outer peripheral surface of the intermediate transfer belt 21 after the secondary transfer process is cleaned by the cleaning device 26.

Subsequently, the sheet P to which the toner images are secondarily transferred is peeled off from the intermediate transfer belt 21, conveyed by a conveying path after the transfer process and introduced to the fixing device 35. In the fixing device 35, the sheet P to which the toner images are transferred is introduced to pass a contact part with which the heating and rotating member 36 and the pressing and rotating member 37 come into contact, and heated and pressed to melt the toner of the toner images and fix the toner image to the sheet P. The sheet P after the fixing process is completed is conveyed to and accommodated in a delivered sheet accommodating part not shown in the drawing.

In accordance with the above-described operations, the full-color image composed of the toner of the four colors is formed on the one surface of the one sheet P and the basic image forming operation is finished. When the image forming operation is instructed for plural sheets, the above-described series of operations are similarly repeated for the number of sheets. Other wise, in the image forming device 1, for instance, only the image creating unit 10K of the black color K of the plural image creating units 10 is operated so that a monochromatic image (in this example, a black and white image) composed of the toner of black color may be formed on the one surface of the sheet P.

In the image forming device 1, during the operations at the time of forming the image as described above, the developer Ga (Y, M, C, K) and the developer Gb (Y, M, C, K) are respectively discharged from the developing devices 14 and the cleaning devices 16 in the image creating units 10 (Y, M, C, K) respectively. Further, the developer Gc is discharged from the second cleaning device 26 in the intermediate transfer unit 20.

Further, in the image forming device 1, depending on the contents of the image to be formed (for instance, when the image is formed with the image concentration of each of the color components in the image creating units 10 that is low as small as 1%), unnecessary developer (actually, the toner) adhering to the intermediate transfer belt 21 may be occasionally more increased than that in other contents of the image and the quantity of the developer Gc removed and discharged in the second cleaning device 26 may be also occasionally increased.

The image forming device 1 includes a developer recovery device 4 that is capable of effectively recovering all the developers Ga, Gb and Gc respectively discharged from the developing devices 14, the first cleaning devices 16 and the second cleaning device 26 to the same recovery container 5.

Now, the developer recovery device 4 will be described below.

The developer recovery device 4 includes, as shown in FIGS. 1A to 5, the recovery container 5, a connecting and conveying device 40, a driving device 41 and a detector 42. The recovery container 5 collectively accommodates the developers Ga, Gb and Gc discharged from the image creating units 10 (Y, M, C, K) and the intermediate transfer unit 20. The connecting and conveying device 40 connects the developing devices 14, the first cleaning devices 16 and the second cleaning device 26 in which the developers Ga, Gb and Gc are respectively generated to the recovery container 5 to convey the developers Ga, Gb and Gc. The driving device 41 rotates a below-described auger (6) provided in the recovery container 5. The detector 42 detects the developer Gd (a mixture of Ga, Gb and Gc) accommodated and accumulated in the recovery container 5.

Figure 4:
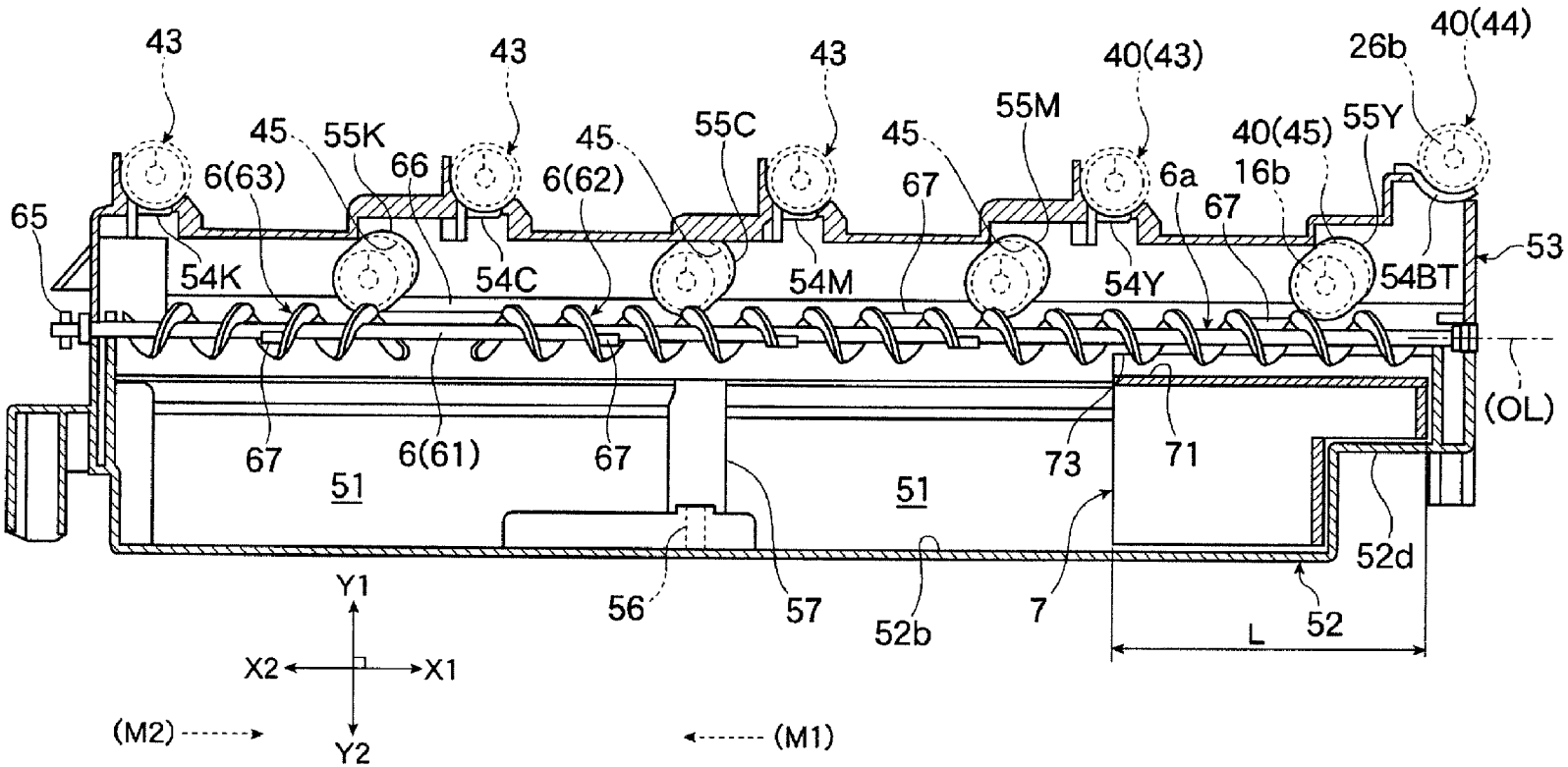
FIG. 4 is a sectional view taken along a line Q1-Q1 of the recovery container shown in FIG. 2.
Figure 5:
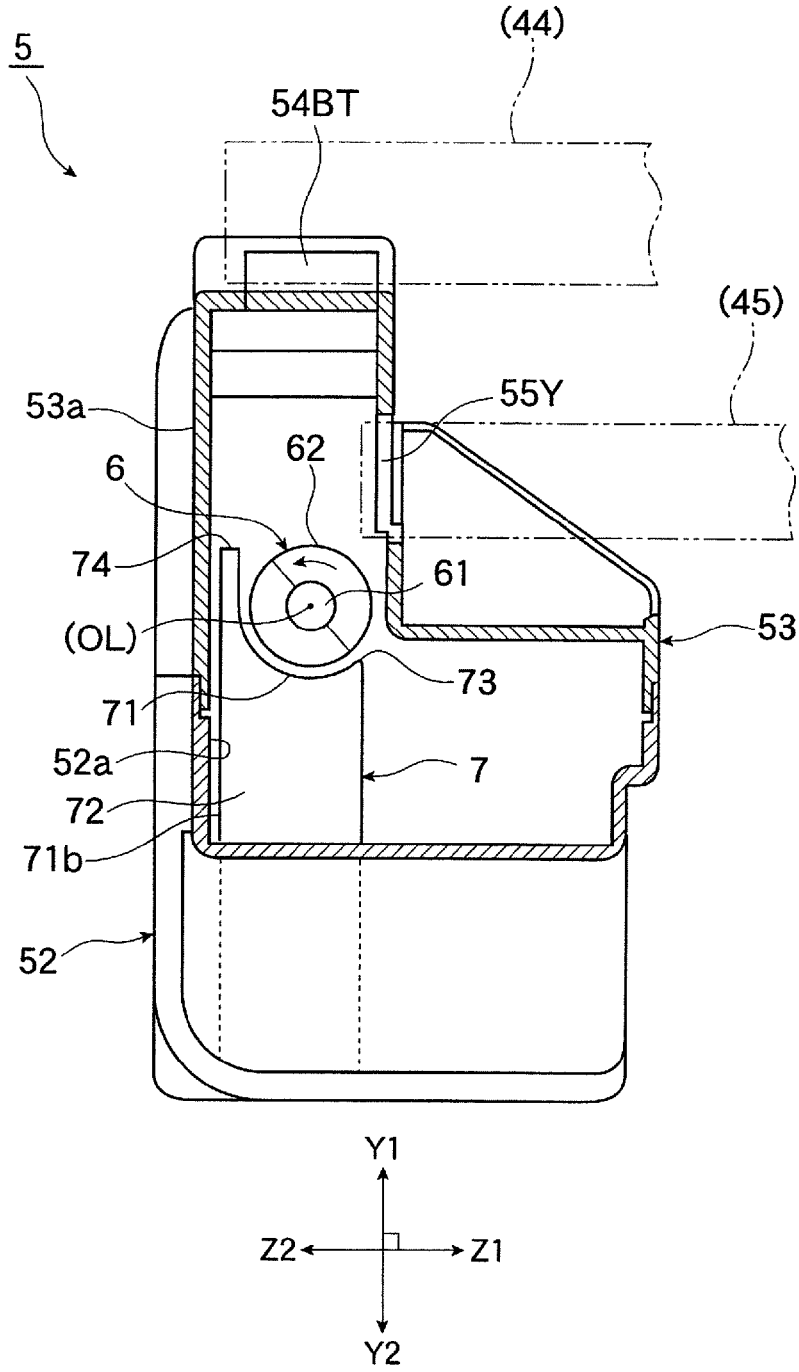
FIG. 5 is a sectional view taken along a line Q2-Q2 of the recovery container shown in FIG. 2.
Figure 6:
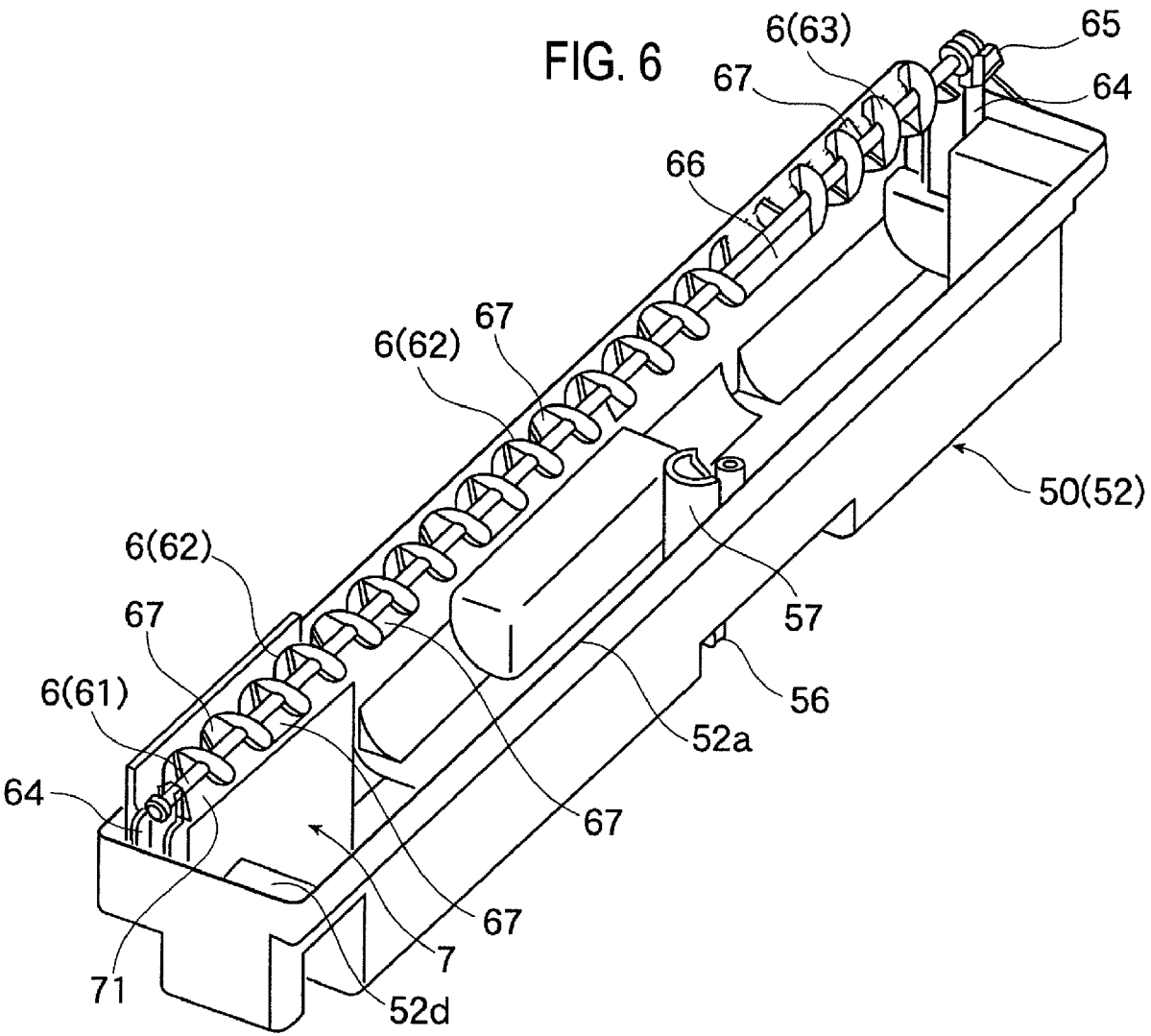
FIG. 6 is a perspective view showing a state after a cover part in the recovery container shown in FIG. 2 is removed.
Figure 7:
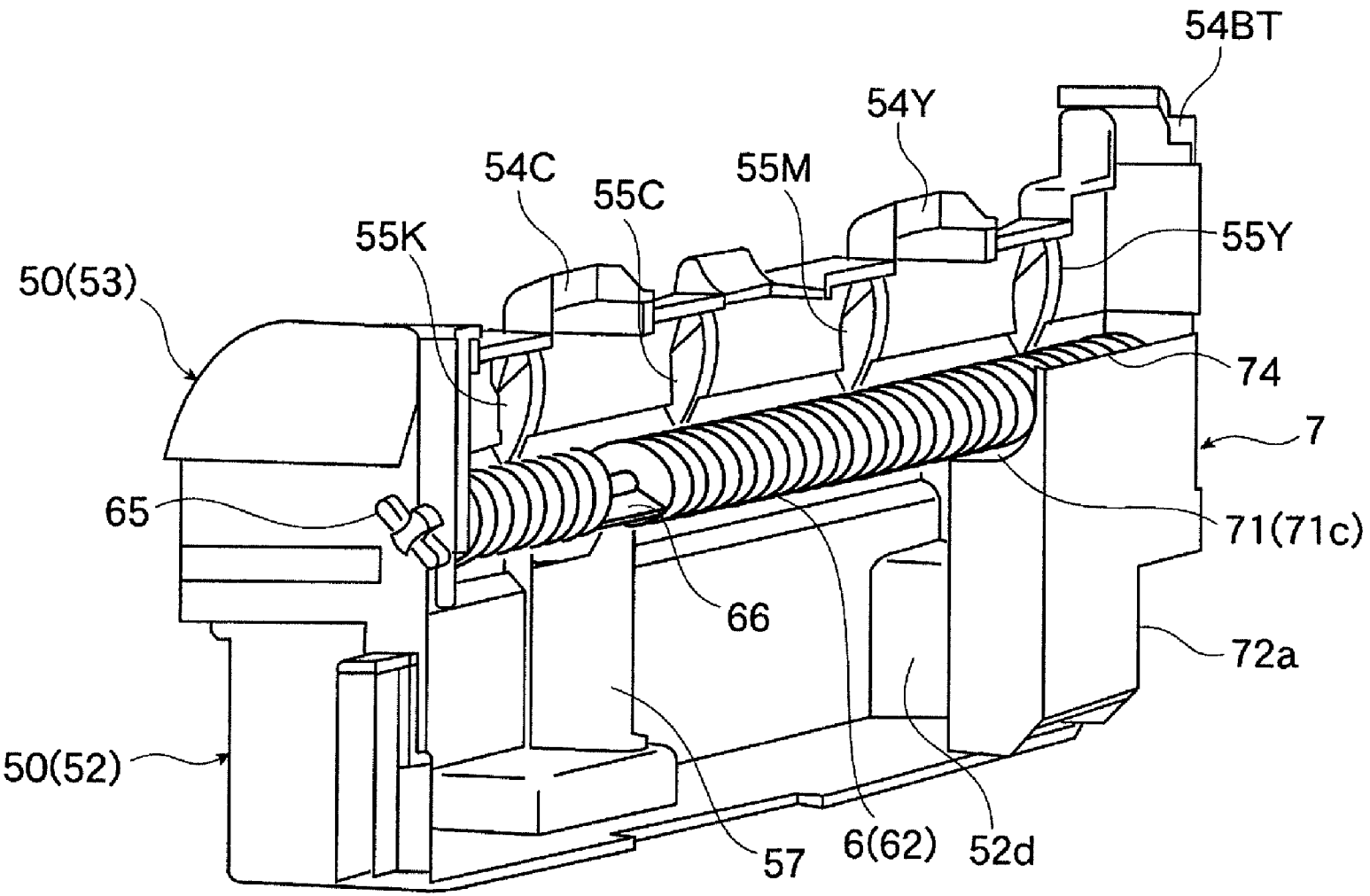
FIG. 7 is a partly sectional perspective view showing a state after the recovery container shown in FIG. 2 is cut and opened at a part substantially along a line Q3-Q3.

FIG. 2 shows the recovery container 5 and the driving device 41. FIG. 3 shows the recovery container 5 under a state that the recovery container 5 in FIG. 2 is seen from a direction of an arrow mark S and the detector 42. FIG. 4 shows a partly sectional view of the recovery container 5 taken along a line Q1-Q1 in FIG. 2. FIG. 5 shows a partly sectional view of the recovery container 5 substantially taken along a dashed line Q2-Q2 in FIG. 2.

The recovery container 5 is, as shown in FIG. 1B, detachably attached and used to an attaching space part formed at a part in the front surface side (a front side: a side of a surface seen in the direction shown by an arrow mark Z1) of the image forming device 1. The attaching space part is formed at, for instance, a position opposed to an end part of the front surface side of the exposure device 13 and the developing devices 14 in the four image creating units 10. Reference numeral 105 in FIG. 1B designates an opening and closing door attached to the casing 101 so as to be freely opened and closed and opened and closed when the recovery container 5 is detached or attached.

The recovery container 5 is formed with a container main body 50 whose external appearance is substantially rectangular. The container main body 50 includes a main body part 52 having an accommodating space 51 formed for mainly accommodating the recovered developers and a cover part 53 for closing the main body part 52 from an upper part and the main body part 52 is connected to the cover part 53. The length of the container main body 50 (a width seen from the front surface side) substantially corresponds to a distance from the cleaning device 16 of the image creating unit 10K of the black K to the second cleaning device 26 of the intermediate transfer unit 20.

In the upper part (the cover part 53) of the container main body 50, a rectangular protruding part 53*a* is formed that protrudes upward along the longitudinal direction (a direction shown by an arrow mark X) of the accommodating space 51 of the main body part 52 in a position biased to the front surface side of the image forming device 1 relative to the main body part 52. On the upper surface part of the protruding part 53*a* of the cover part 53, five receiving ports 54 are formed for receiving the developers to be recovered (see FIG. 2). Further, in the side wall part of a rear surface side in the protruding part 53*a* (a rear side: a side of a surface seen in a direction shown by an arrow mark Z2), four receiving ports 55 are formed (see FIG. 3).

The five receiving ports of the upper surface part are ports (54BT, 54Y, 54M, 54C, 54K) for solely receiving the developers Gb, Gc respectively discharged from the second cleaning device 26, the cleaning device 16 of the yellow Y, the cleaning device 16 of the magenta M, the cleaning device 16 of the cyan C and the cleaning device 16 of the black K from the right side of the sheet surface in FIG. 2. The four receiving ports 55 of the side wall part are ports (55K, 55C, 55M, 55Y) for solely receiving the developers Ga respectively discharged from the developing device 14 of the black K, the developing device 14 of the cyan C, the developing device 14 of the magnet M and the developing device 14 of the yellow Y from the right side of the sheet surface in FIG. 3.

In a lower part of the container main body 50 (the main body part 52), as shown in FIG. 3, a transparent box shaped detecting space part 56 to which a part of the developer is dropped to be accommodated is formed in a protruding state on the rear surface side of a bottom surface part. Further, in the accommodating space 51 of the main body part 52, a developer introducing pipe 57 connected to the detecting space part 56 is provided upright as shown in FIGS. 4 to 7. The developer introducing pipe 57 is formed with a prescribed height from the bottom surface part of the accommodating space 51 to its opening. As long as the developer Gd accommodated and accumulated in the accommodating space 51 does not exceed the height of the introducing pipe 57, the developer Gd does not enter the inner part of the detecting space part 56 through the introducing pipe 57.

Further, the recovery container 5 is provided with, as shown in FIGS. 4 to 7, the auger 6 located in an biased state on an upper part of the opening of the main body part 52 of the container main body 50, along the longitudinal direction of the accommodating space 51 of the main body part 52 and just below the protruding part 53*a* of the cover part 53.

The auger 6 is adapted to pull down and convey the developer accumulated in such a state as to exceed the height (an upper limit of accommodation) of the opening (an upper end of the accommodating space 51) of the container main body 50 at the time of a recovery. Specifically, the auger 6 includes a rod shaped rotating shaft 61 and spiral vanes 62 and 63 protruding spirally on the rotating shaft 61. Further, in the auger 6, both end parts of the rotating shaft 61 are attached to bearing members 64 disposed in the main body part 52 so as to freely rotate. Further, to one end part of the rotating shaft 61, a shaft connecting member (a coupling) 65 is attached for connecting the rotating shaft to the driving shaft of the driving device 41.

The spiral vanes 62 and 63 are formed in a falsely continuous form by alternately connecting two semi-circular plates whose inclined directions are different from each other. Further, the winding directions of the spiral vanes 62 and 63 are different from each other, so that when the rotating shaft 61 is rotated in a prescribed direction, the accommodated and accumulated developer is conveyed to a central part from both the end parts of the rotating shaft 61. As shown in FIG. 4, dotted line arrow marks M1 and M2 show conveying directions of the spiral vanes 62 and 63. In the first exemplary embodiment, the spiral vanes 62 and 63 are interrupted at a position a little nearer to the receiving port 54K of the black K from a position just below the receiving port 54C corresponding to the cleaning device 16 of the cyan C. Thus, when the auger 6 is rotated, a part of the developer accumulated in the form of a mountain in the accommodating space 51 of the main body part 52 is conveyed to directions respectively by the spiral vanes 62 and 63 and pulled down toward the position where both the spiral vanes 62 and 63 are interrupted.

In the first exemplary embodiment, the auger 6 is provided under a state that the auger 6 is located immediately below the five receiving ports 54 formed in the protruding part 53*a* of the cover part 53 and substantially just below the four receiving ports 55 formed in the protruding part 53*a* (see FIGS. 4 and 5). Further, the auger 6 is arranged in such a way that a lowermost part of the spiral vane 62 (63) is located at a height E exceeding the upper end 52*a* of the main body part from a bottom surface part 52*b* of the accommodating space 51 of the container main body part 52 (see FIG. 9).

Further, in the auger 6, a plate shaped vane 66 parallel to the axial direction is provided at the position where the spiral vanes 62 and 63 are interrupted. Similar plate shaped vanes 67 are provided so as to be dotted in the intermediate parts of the spiral vanes 62 and 63. The plate shaped vanes 66 and 67 feed the developer, when the rotating shaft 61 is rotated, in the direction orthogonal to the direction of the rotating shaft 61 (for instance, the direction intersecting the direction of the rotating shaft 61 within a range of angle of 85 to 95°).

The connecting and conveying device 40 in the developer recovery device 4 includes, as shown in FIGS. 1A, 4 and 5, first connecting and conveying parts 43, a second connecting and conveying part 44, and third connecting and conveying parts 45. The first connecting and conveying parts 43 are provided between the cleaning devices 16 in the image creating units 10 (Y, M, C, K) respectively and the receiving ports 54 (Y, M, C, K) of the recovery container 5. The second connecting and conveying part 44 is provided between the cleaning device 26 in the intermediate transfer unit 20 and the receiving port 54BT of the recovery container 5. The third connecting and conveying parts 45 are provided between the developing devices 14 in the image creating units 10(Y, M, C, K) respectively and the receiving ports 55(Y, M, C, K) of the receiving container 5.

Each of the connecting and conveying parts 43 to 45 is formed with a conveying pipe and a conveying member such as an auger rotating in the conveying pipe to convey the developer. The conveying member in each connecting and conveying part may be rotated by receiving a power of an exclusive rotating and driving device, and a rotating power of a rotating and driving device in the image creating device 2 of the image forming device 1 may be employed.

According to the first exemplary embodiment, in the first connecting and conveying parts 43, the conveying members 16*b* of the cleaning devices 16 (Y, M, C, K) are respectively extended so as to reach the receiving ports 54 (Y, M, C, K) of the recovery container 5. The extended parts of the extended conveying members 16*b* are put into the conveying pipes so that the developer Gb removed respectively by the cleaning devices 16 is conveyed until the developer Gb reaches the receiving ports 54 respectively. Further, in the second connecting and conveying part 44, the conveying member 26*b* of the second cleaning device 26 is extended so as to reach the receiving port 54BT of the recovery container 5. The extended part of the extended conveying member 26*b* is put into the conveying pipe so that the developer Gc removed by the cleaning device 26 is conveyed until the developer Gc reaches the receiving port 54BT. Further, in the third connecting and conveying parts 45, conveying members 14*b* of the developing devices 14 (Y, M, C, K) are respectively extended so as to reach the receiving ports 55 (Y, M, C, K) of the recovery container 5. The extended parts of the extended conveying members 14*b* are put into the conveying pipes so that the developer Ga removed respectively by the developing devices 14 is conveyed until the developer Ga reaches the receiving ports 55 respectively. In the parts of the conveying pipes of the connecting and conveying parts 43 to 45 connected to the receiving ports respectively, discharge ports of the developer are formed.

In the connecting and conveying parts 43 to 45 respectively, when the recovery container 5 is attached thereto, the conveying pipes of the first connecting and conveying parts 43 and the second connecting and conveying part 44 are connected to the receiving ports 54 (Y, M, C, K) and the receiving port 54BT so as to come into contact with the upper parts of the receiving ports 54 and receiving port 54BT. The conveying pipes of the third connecting and conveying parts 45 are connected to the receiving ports 55 (Y, M, C, K) so as to be slightly inserted into the receiving ports 55.

The driving device 41 includes a motor as a driving source and a mechanism for transmitting the rotating power of the motor, and has a driving shaft for an output as a drive transmitting mechanism. When a motor exclusive for the driving device 41 is used, the motor is necessary. However, when the rotating power of the driving device in the image forming device 1 is used, the motor is not necessary. In this case, the driving device 41 is formed with only a rotation transmitting mechanism.

The driving device 41 is provided adjacently to an attaching space of the recovery container 5 in the image forming device 1 (see FIG. 1B), and the driving shaft for the output of the driving device 41 is connected to the shaft connecting member 65 of the auger 6 in the recovery container 5 attached to the side surface part of the attaching space. Further, the driving device 41 transmits the rotating power to the auger 6 to rotate the auger 6 in the direction shown by an arrow mark as a direction for generating a prescribed conveying force as shown in FIG. 5 (in this case, counterclockwise).

The detector 42 detects, for instance, that a quantity of the developer Gd accommodated and accumulated in the recovery container 5 reaches a set quantity.

The detector 42 is formed with an optical light transmission type sensor including a light emitting part 42*a* and a light receiving part 42*b* that detects whether or not the developer is accumulated to a prescribed level (the height of accumulation) in the detecting part 56 formed on the bottom surface part of the main body part 52 of the container main body 50 on the basis of the presence or absence of the transmission of a detecting light. Further, the light transmission type sensor forming the detector 42 is provided adjacently to the bottom surface part of the attaching space of the recovery container 5 in the image forming device 1 (see FIG. 1B). When the recovery container 5 is attached to the attaching space, the detecting part 56 is sandwiched between the light emitting part 42*a* and the light receiving part 42*b* in the sensor.

Then, in the recovery container 5, as shown in FIGS. 4 to 7, a movement assist member 7 having a moving passage surface 71 provided in the lower part of one part 6*a* of the auger 6 in the accommodating space 51 of the main body part 52 of the container main body 50 and opposed to the part 6*a* to receive the dropping developer Gc and the like and move the developer by the conveying force of the auger 6.

Figure 8:
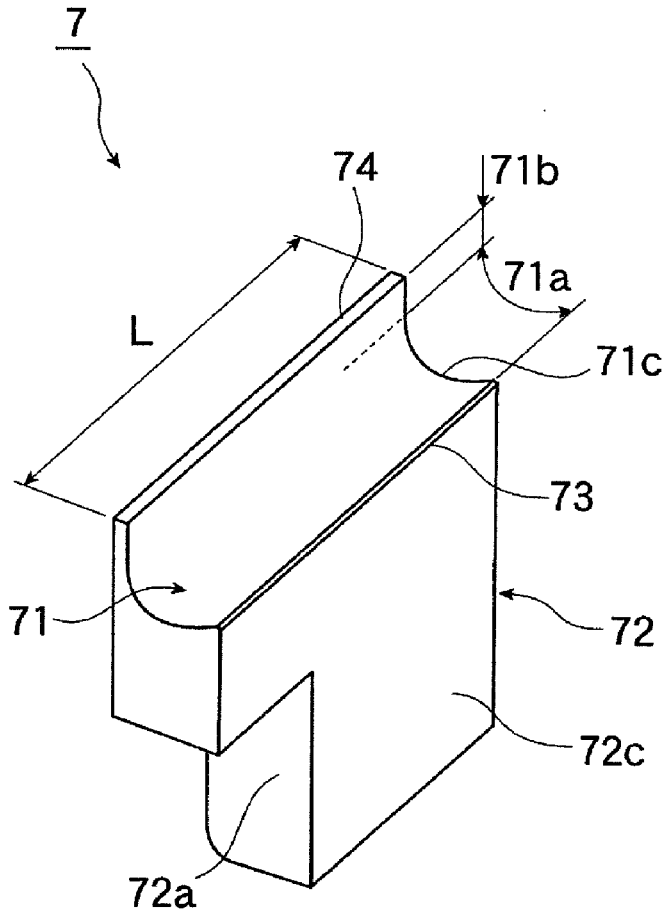
FIG. 8 is a perspective view showing a movement assist member.

The movement assist member 7 entirely has a substantially box shape as shown in FIG. 8 and is a structural member having the moving passage surface 71 formed on an upper part. In the first exemplary embodiment, the movement assist member 7 has a box shaped body part 72 under the moving passage surface 71. A part of a lower part of the body part 72 is formed as a recessed part 72*a* recessed so as to be drawn back inside correspondingly to a stepped part 52*d* (see FIG. 4) in the main body part 52 of the container main body 50. Further, in the movement assist member 7, one side surface part 72*b* of the body part 72 is arranged so as to come close to or come into contact with an inner wall surface 52*f* of the front surface side of the accommodating space 51 (see FIGS. 9, 10).

The moving passage surface 71 has a J shaped section and is formed with a grooved shaped surface extending along a central line OL of rotation of the auger 6 (see FIGS. 4 and 5). Further, as shown in FIG. 4, the moving passage surface 71 is formed to be opposed to the spiral vane 62 in the one part 6*a* of the auger 6 existing in a section from the receiving port 54BT to the receiving port 54(Y). That is, the moving passage surface 71 is formed with a length L corresponding to a distance from a position substantially just below the receiving port 54BT to a position substantially just below the receiving port 54(Y).

Further, in the moving passage surface 71, as shown in FIG. 5, upper end parts 73 and 74 of two side surfaces opposed to each other with the central line OL of rotation of the auger 6 sandwiched between them are formed with relatively different heights. The central line OL of rotation is a straight line obtained by connecting central points when the auger rotates and corresponds to the central line of the rotating shaft 61 in the first exemplary embodiment. The heights of the upper end parts 73 and 74 of the side surfaces at this time are dimensions separated from the bottom surface part 52*b* (a common surface) of the container main body part 52 as a bottom surface of the accommodating space 51.

Figure 9:
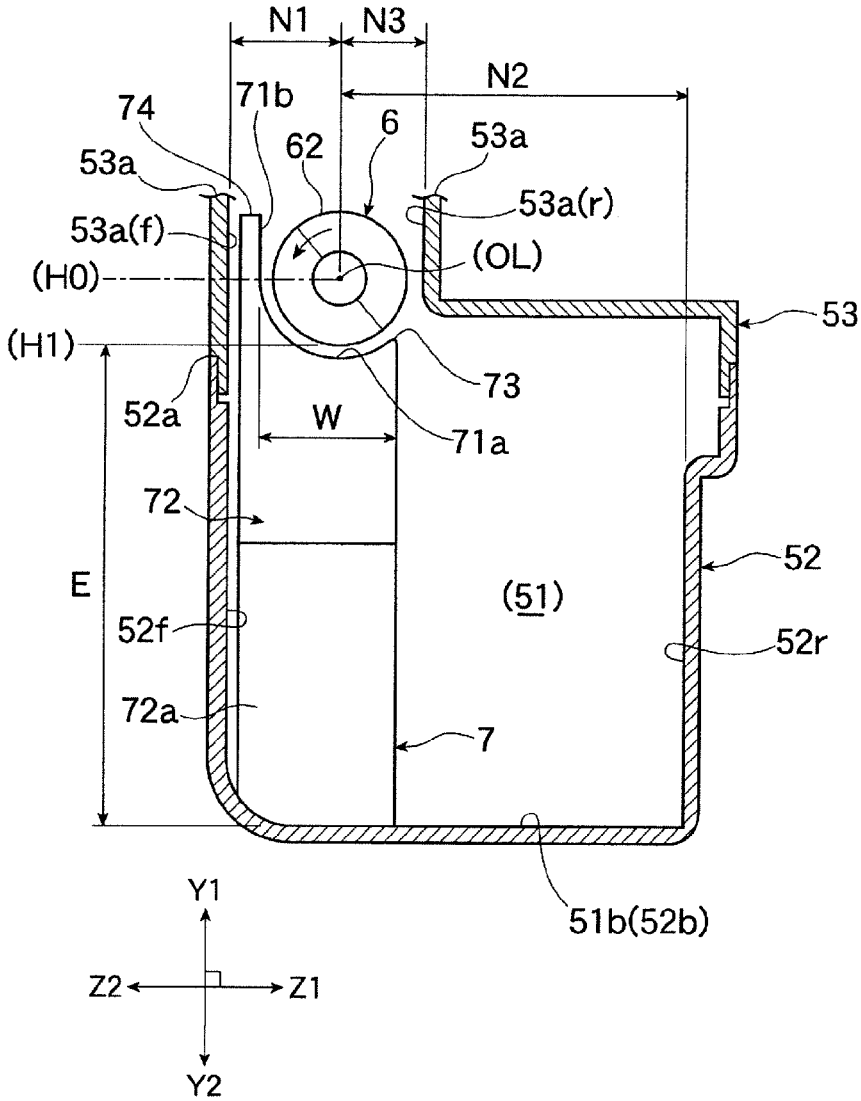
FIG. 9 is an explanatory view showing the structure of the movement assist member.

In the first exemplary embodiment, as shown in FIG. 9, the main inner wall surfaces 52*f* (an inner wall surface of a front surface side) and 52*r* (an inner wall surface of a rear surface side) of the accommodating space 51 of the container main body part 52 are opposed to each other with the central line OL of rotation of the auger 6 sandwiched between them, and a distance N (N1) separated from the central line OL of rotation to the inner wall surface 52*f* is shorter than a distance N (N2) separated from the central line OL of rotation to the inner wall surface 52*r*. For the upper end parts 73 and 74 of the side surfaces, the upper end part 74 of the side surface located in a side of the inner wall surface 52*f* having the shorter distance N1 is formed to be higher than the upper end part 73 of the side surface located in a side of the other inner wall surface 52*r*. In the case of the first exemplary embodiment, inner wall surfaces 53*a*(f) and 53*a*(r) are provided in the protruding part 53*a* of the cover part 53 that are opposed to each other with the central line OL of rotation of the auger 6 sandwiched between them. However, since the two inner wall surface 53*a*(f) and 53*a*(r) are not the inner wall surfaces of a part for accommodating the developer, they do not correspond to objects as references for setting the heights of the upper end parts 73 and 74 of the side surfaces of the moving passage surface 71. The distance N3 of the inner wall surface 53*a*(r) in the protruding part 53*a* of the cover part 53 separated from the central line OL of rotation is shorter than the distance N1 of the inner wall surface 52*f* separated from the central line OL of rotation (N3<N1).

Further, in another point of view, when the upper end parts 73 and 74 of the side surfaces are seen from an upstream side of a conveying direction by the spiral vane 62 of the auger 6 along the central line OL of rotation (a direction shown by a dotted line arrow mark M1 shown in FIG. 4), the upper end part 74 of the side surface located in a side moving to a lower part from an upper part when the spiral vane 62 rotates in the direction shown by the arrow mark is formed so as to be higher than the upper end part 73 of the other side surface.

The upper end part 73 of the side surface having a relatively low height is formed with the height lower than the height (H0) of the central line OL of rotation of the auger 6 as shown in FIG. 9. Further, the upper end part 74 of the side surface having a relatively high height is formed with the height not lower than the height (H0) of the central line OL of rotation of the auger 6. In this connection, when the upper end part 74 of the side surface having the relatively high height is formed with the height exceeding the height (H0), the height of the upper end part 73 of the side surface having the relatively low height may be preferably set to the height not higher than the height (H0) of the central line of rotation from the viewpoint that the developer is allowed to drop over the upper end part 73 of the side surface during a moving process of the moving passage surface 71.

In the first exemplary embodiment, as the auger 6, for instance, when the spiral vane 62 having, during its rotation, an outside diameter of 18 mm formed relative to the rotating shaft 61 of 7 mmϕ is used, the lower upper end part 73 of the side surface of the moving passage surface 71 is formed with the height lower than the height (H0) of the central line OL of rotation of the auger 6 and higher by 2 mm than the height (H1) of a lowermost part of the spiral vane 62 during its rotation. Further, when the auger 6 is used, the upper end part 74 of the side surface of the moving passage surface 71 is formed with the height substantially the same as the height (H2: see FIG. 13) of an uppermost part of the spiral vane 62 of the auger 6 during its rotation.

Further, in the moving passage surface 71, as shown in FIGS. 5 and 9, a surface part 71*a* opposed to a part of the spiral vane 62 existing in a part lower than the height (H0) of the axis OL of rotation of the auger 6 is formed with a cylindrical curved surface opposed to the lower part of the spiral vane 62 with the substantially same space. The cylindrical curved surface is an outer peripheral of a cylindrical surface having a value as a radius obtained, for instance, by adding a dimension of the space when the surface part 71*a* is opposed to the part of the spiral vane 62 to the radius of the auger 6 during its rotation. Further, in the moving passage surface 71, a surface part 71*b* of an area to the upper end part 74 of the side surface opposed to a part of the spiral vane 62 higher than the height (H0) of the axis or the central line OL of rotation of the auger 6 is formed with a plane (a vertical surface) rising in a substantially vertical direction (a direction substantially along an arrow mark Y1).

The developer is recovered by the developer recovery device 4 in such a way as described below.

In the developer recovery device 4, the connecting and conveying device 40 and the driving device 41 operate during the image forming operation. Thus, the conveying members of the connecting and conveying parts 43 to 45 in the connecting and conveying device 40 respectively receive the power and are respectively rotated and driven in the conveying pipes. Further, the auger 6 in the recovery container 5 receives the power of the driving device 41 and is rotated and driven in the prescribed direction (the direction shown by the arrow mark).

As a result, as shown FIGS. 1A and 4, the developer Ga (y, M, C, K) generated from the developing devices 14 in the image creating units 10 (Y, M, C, K) of the image forming device 1 in accordance with the trickle system is conveyed to the receiving ports 55 (Y, M, C, K) of the recovery container 5 through the third connecting and conveying parts 45. Further, the developer Gb (Y, M, C, K) generated from the first cleaning devices 16 in the image creating units 10 (Y, M, C, K) during the cleaning operation is conveyed to the receiving ports 54 (Y, M, C, K) of the recovery container 5 through the first connecting and conveying parts 43 until the developer reaches the receiving ports 54. Further, the developer Gc generated from the second cleaning device 26 on the intermediate transfer unit 20 during the cleaning operation is conveyed to the receiving port 54BT of the recovery container 5 through the second connecting and conveying part 44 until the developer reaches the receiving port 54BT.

Figure 10:
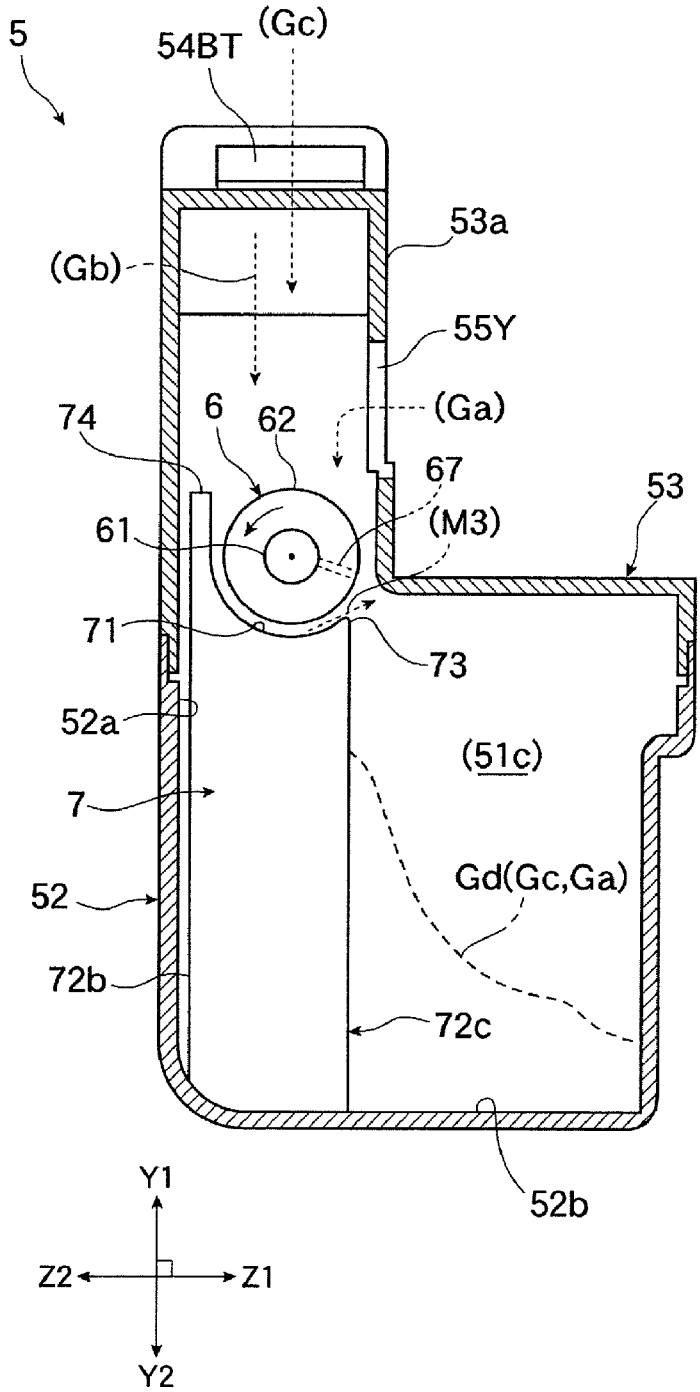
FIG. 10 is a partly sectional explanatory view showing a position where a moving and conveying member is provided in the recovery container and an accommodated state of the developer in a peripheral part thereof.
Figure 11:
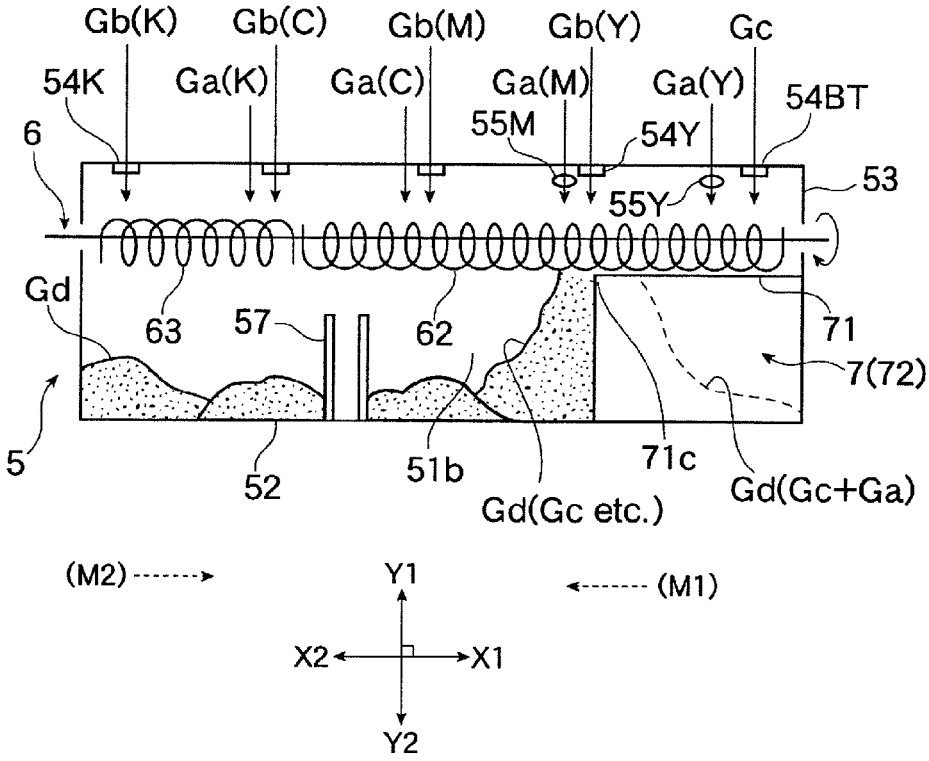
FIG. 11 is an explanatory view showing the accommodated state (entire part) of the developer to the recovery container.

The developers Ga, Gb and Gc conveyed to the receiving ports 54 and 55 of the recovery container 5 are respectively dropped and accommodated in the accommodating space 51 in the main body part 52 of the container main body 50 from their receiving ports as shown in FIGS. 10 and 11.

Figure 16:
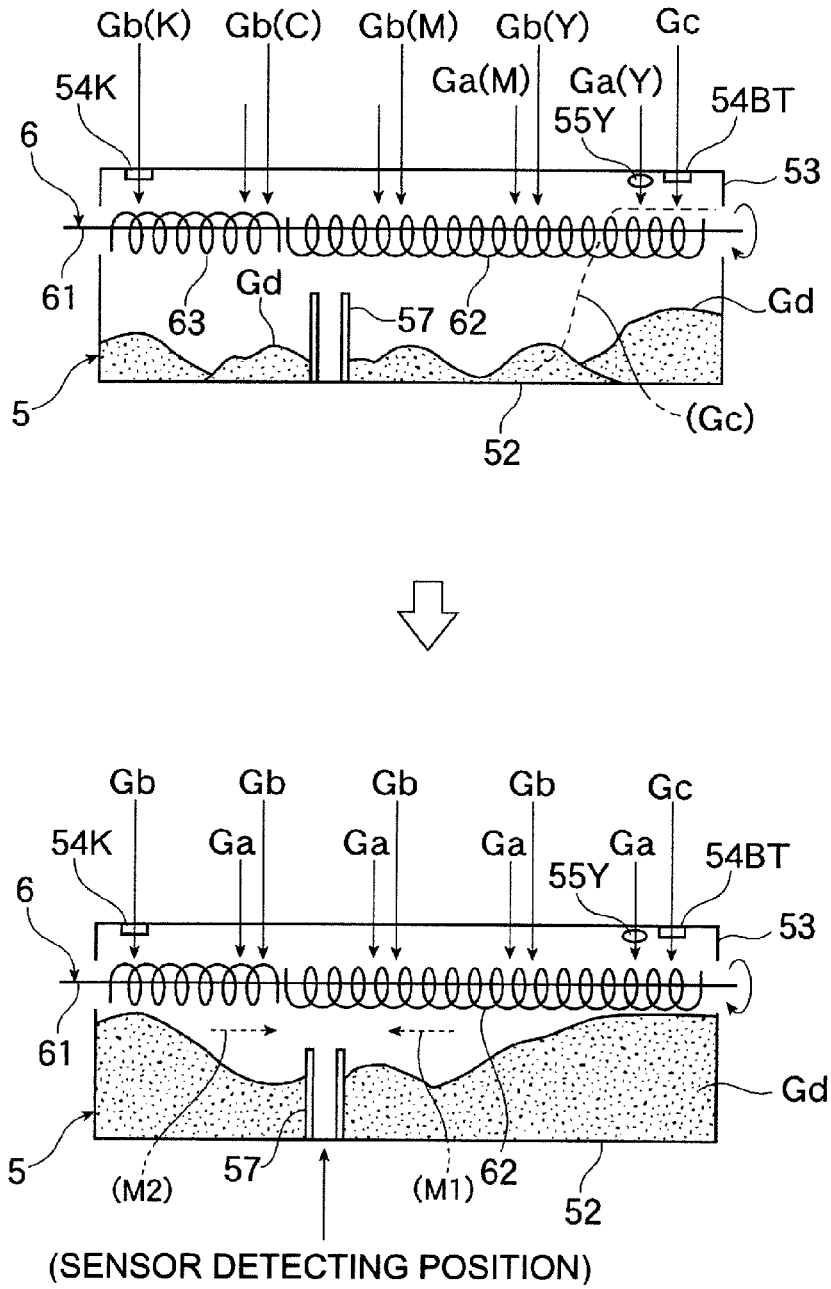
FIG. 16 is an explanatory view showing an accommodated state (an entire part and an elapsing state) of the developer to the recovery container having no movement assist member.

At this time, the developer Gb(Y, M, C, K) and the developer Ga(M, C, K) respectively dropping through the receiving ports 54(Y, M, C, K) and the receiving ports 55 (M, C, K) that are provided in a range where the movement assist member 7 is not provided in the recovery container 5 come into contact (collide) with the auger 6 during a dropping operation and are finally accumulated in the forms of mountains at the positions in the accommodating space 51 corresponding to positions substantially just below the receiving ports 54 and 55 (see upper parts of FIGS. 11 and 16). FIG. 16 shows a recovery state of the developer when the recovery container 5 is used that is not provided with the movement assist member 7.

Further, when the developer Gb (Y, M, C, K) and the developer Ga (M, C, K) respectively dropping and accommodated through the receiving ports 54(Y, M, C, K) and the receiving ports 55 (M, C, K) are accommodated until the upper parts of the developer (an accumulated developer) stacked in the forms of mountains reach a height in contact with the spiral vanes 62 and 63 of the auger 6, the developer is pulled down by the spiral vanes 62 and 63 as described above and conveyed along the conveying directions M1 and M2 of the spiral vanes respectively (see a lower part of FIG. 16).

Further, when the developer is accommodated and accumulated one by one in the accommodating space 51 of the recovery container 5 and a part of the accommodated and accumulated developer Gd exceeds the height of the developer introducing pipe 57, the developer Gd exceeding the height of the introducing pipe 57 is dropped and accommodated in the detecting part 56 through the introducing pipe 57. After that, when a quantity of the developer Gd accommodated in the detecting part 56 exceeds a prescribed quantity, a part between the light emitting part 42*a* and the light receiving part 42*b* of the light transmission type sensor of the detector 42 is interrupted by the developer Gd so that a quantity of received light in the light receiving part 42*b* of the sensor is changed (lowered). As result, it is detected that the quantity of the developer Gd accommodated and accumulated in the recovery container 5 reaches a set quantity (a standard quantity at which the recovery container 5 is to be exchanged).

Then, in the recovery device 4, as shown in FIGS. 10 and 11, when the developer Gc an the developer Ga (Y) respectively dropping through the receiving port 54BT and the receiving port 55(Y) existing in the range where the movement assist member 7 is provided in the recovery container 5 come into contact with the part 6*a* of the auger 6 existing in the lower part of the receiving port 54BT and the receiving port 55(Y) and slip out between the spiral vanes 62, the developer Gc and the developer Ga(Y) slipping out the spiral vanes are temporarily received by the moving passage surface 71 of the movement assist member 7.

Subsequently, the developer Gd (Gc+Ga(Y)) received by the moving passage surface 71 is held by the moving passage surface 71 and conveyed substantially along the conveying direction M1 of the spiral vane 62 mainly by receiving the conveying force of the spiral vane 62 of the auger 6. This conveying direction M1 is a direction substantially parallel to the central line OL of rotation of the auger 6 (see FIG. 4). Further, a part of the developer Gd (Gc+Ga(Y)) at this time receives the conveying force of the plate shaped vane 67 existing in the area of the auger 6 opposed to the moving passage surface 71 as well as the conveying force of the spiral vane 62 and is conveyed in the conveying direction M3 of the plate shaped vane 67 and fed from an intermediate part of the longitudinal direction of the moving passage surface 71 as shown in FIG. 10. The conveying direction M3 corresponds to a direction substantially orthogonal to the central line OL of rotation.

Thus, the developer Gd (Gc+Ga(Y)) received by the moving passage surface 71 is held and guided by the moving passage surface 71 of the movement assist member 7 and conveyed by a distance corresponding to the length L of the moving passage surface 71, and then, dropped from one end part 71*c* in the longitudinal direction of the moving passage surface 71 and accommodated in a space part 51*b* in the downstream side of the conveying direction M1 from the movement assist member 7 in the accommodating space 51 of the container main body part 52 (see FIG. 11). Further, a part of the developer Gd (Gc+Ga(Y)) drops over an upper end part 73 of the side surface of the moving passage surface 71 in the part of the auger 6 provided with the plate shaped vane 67 and is accommodated in a space part 51*c* of a rear surface side in the accommodating space 51 where the movement assist member 7 (its body part 72) does not exist (see FIG. 10). Especially, in the recovery container 5, the length L of the moving passage surface 71 is changed to a prescribed length so that the moving distance and an accumulated position of the developer Gc may be adjusted.

Consequently, the developer Gd (Gc+Ga(Y)) received by the moving passage surface 71 is not accumulated at positions in the accommodating space 51 respectively corresponding to positions substantially just below the receiving ports 54BT and 55 (Y) as shown in FIG. 11 and is conveyed through the moving passage surface 71 so that the developer is accumulated at positions shifted from the positions corresponding to the positions substantially just below the receiving ports. In the first exemplary embodiment, the developer is accumulated at positions respectively corresponding to positions substantially just below the receiving ports 54Y and 55M. Further, a part of the developer Gd (Gc+Ga(Y)) drops in the space part 51*c* of the rear surface side of the accommodating space 51 in which the body part 72 of the movement assist member 7 does not exist and is accumulated under a state that the developer comes into contact with other side surface part 72*c* of the body part 72 of the movement assist member 7, as shown in FIG. 10. Thus, the developer Gd is distributed and accommodated without wastefulness.

Here, in the image forming device 1 having the developer recovery device 4, as described above, the unnecessary developer adhering to the intermediate transfer belt 21 may be occasionally increased depending on the contents of the image. Thus, the quantity of the developer Gc removed and discharged by the second cleaning device 26 may be occasionally increased more than the quantity of other discharged developers Ga and Gb. In accordance with this influence, in the recovery container 5, a quantity of the developer Gc conveyed through the receiving port 54BT per unit time may be occasionally increased more than those of the developers Ga and Gb conveyed through other receiving ports 54 and 55.

Although an outstanding difference arises in the quantities of conveyed developers in the plural receiving ports 54 and 55, for instance, when the recovery container 5 is used which is not provided with the movement assist member 7 in the lower part of the receiving port 54BT (see FIG. 16), an accommodated state of the developer Gc dropping and accommodated from the receiving port 54BT has below-described difficulties.

Namely, in the recovery container 5 that is not provided with the movement assist member 7, the developer Gc whose conveyed quantity is increased is relatively rapidly accumulated at a position in the accommodating space 51 corresponding to the position substantially just below the receiving port 54BT. That is, a speed at which the developer Gc is accumulated at the position is higher than a speed at which the developers Ga and Gb dropping and accommodated from other receiving ports 54 and 55 are accumulated at positions in the accommodating space 51 corresponding to positions substantially just below the receiving ports of the developers Ga and Gb. Further, the developer Gc frequently adheres to an inner wall surface 52*f* (see FIG. 9) of the accommodating space 51 close to the receiving port 54BT during the dropping operation from the receiving port 54BT and the developer Gc adhering to the inner wall surface 52*f* gradually grows upward the inner wall surface 52*f* as a lump.

Then, the developer Gc growing upward along the inner wall surface 52*f* finally grows to a position exceeding the height of the auger 6. Accordingly, the recovered developer is further dropped and accumulated on the growing developer Gc until the auger 6 is gradually covered with and buried in the developer, so that the conveying force of the auger 6 is not adequately obtained or is lost due to the presence of the developer. Particularly, in a stage before other developers Ga and Gb reach the height of the auger 6, a part between the inner wall surface 52*f* and the auger 6 is clogged with the developer Gc dropping from the receiving port 54BT. Such circumstances are repeated so that the developer Gc received from the receiving port 54BT exceeds the height of the auger 6 and is accumulated (such a state as shown by a dotted line Gc in an upper part of FIG. 16). In a worst case, a part of the developer Gc overflows from the receiving port 54BT.

As compared therewith, in the recovery container 5 provided with the movement assist member 7 in the first exemplary embodiment, the developer Gc dropping and accommodated from the receiving port 54BT is conveyed through the moving passage surface 71 of the movement assist member 7 as described above.

Therefore, the developer Gc is not concentrically accumulated at the position in the accommodating space 51 corresponding to the position substantially just below the receiving port 54BT and is accumulated at the position shifted from the position corresponding to the position substantially just below the receiving port 54BT, as shown in FIG. 11. Thus, even when the developer Gc is relatively more conveyed and received through the receiving port 54BT, the developer Gc is not concentrically accumulated at the position in the accommodating space 51 corresponding to the position substantially just below the receiving port 54BT as shown by the dotted line Gc in the upper part of FIG. 16.

Further, in the recovery container 5 provided with the movement assist member 7, a part of the developer Gc dropping and accommodated from the receiving port 54BT may possibly receive such a conveying force as to take up the developer by the spiral vane 62 of the auger 6 to drop over the lower upper end part 73 of the side surface during the conveying process of the developer in the longitudinal direction of the moving passage surface 71 by the conveying force of the auger 6, due to the presence of the relatively lower upper end part 73 of the side surface of the moving passage surface 71 in the movement assist member 7.

Further, even when the developer Gc dropping and accommodated from the receiving port 54BT drops closely to the side wall surface 52*f* of the accommodating space 51 near the upper end part 74 of the side surface, the developer is apt to be received by the moving passage surface 71 due to the presence of the upper end part 74 of the side surface of the moving passage surface 71 that is formed to be relatively high in the movement assist member 7 and hardly drops under the auger 6. Accordingly, during the dropping process of the developer Gc, the developer hardly adheres to the inner wall surface 52*f* of the accommodating space 51. Further, one side surface part 72*a* of the body part 72 of the movement assist member 7 is located so as to substantially close the inner wall surface 52*f* of the accommodating space 51. As a result, the developer Gc hardly adheres to the inner wall surface 52*f* of the accommodating space 51 during the dropping process of the developer Gc.

Accordingly, in the recovery container 5 provided with the movement assist member 7, even when the developer whose conveyed quantity is relatively increased is conveyed from the receiving port 54BT, the developer is not concentrically accumulated at the position substantially just below the receiving port 54BT. Therefore, in the recovery container 5, such a phenomenon as in the above-described case (see FIG. 16) that the recovery container 5 having no movement assist member 7 is used does not occur, for instance, the developer Gc is accumulated to the height exceeding the height of the auger 6 to deteriorate the conveying capability of the auger 6 and clog the auger with the developer Gc, or the developer Gc is further accumulated to overflow from the receiving port 54BT. When the recovery container 5 is applied, the developers Ga, Gb and Gc are entirely recovered to the recovery container 5 without a special difficulty and smoothly recovered by effectively using the accommodating space 51.

Further, in the recovery container 5 having the movement assist member 7, a part of the developer Gc dropping and accommodated from the receiving port 54BT may occasionally drop over the lower upper end part 73 of the side surface during the conveying process on the moving passage surface 71 as described above. As a result, the developer does not remain on the moving passage surface 71, nor adheres especially to the side surface part rather than to the bottom surface part. Further, the developer Gc dropping during the conveying process is also distributed and accommodated in the space part 51*c* of the rear surface side of the accommodating space 51 in which the movement assist member 7 does not exist (see FIG. 10). The accommodation of the developer in the space part 51*c* is more promoted by the plate shaped vane 67 of the auger 6. Thus, a rate of the developer accumulated concentrically to the space part 51*b* in the downstream side of the conveying direction M1 of the accommodating space 51 through the moving passage surface 71 is also reduced (see FIG. 11). Further, in the recovery container 5, the accommodating space 51 is more effectively used without wastefulness.

Another Exemplary Embodiment

Figure 12:
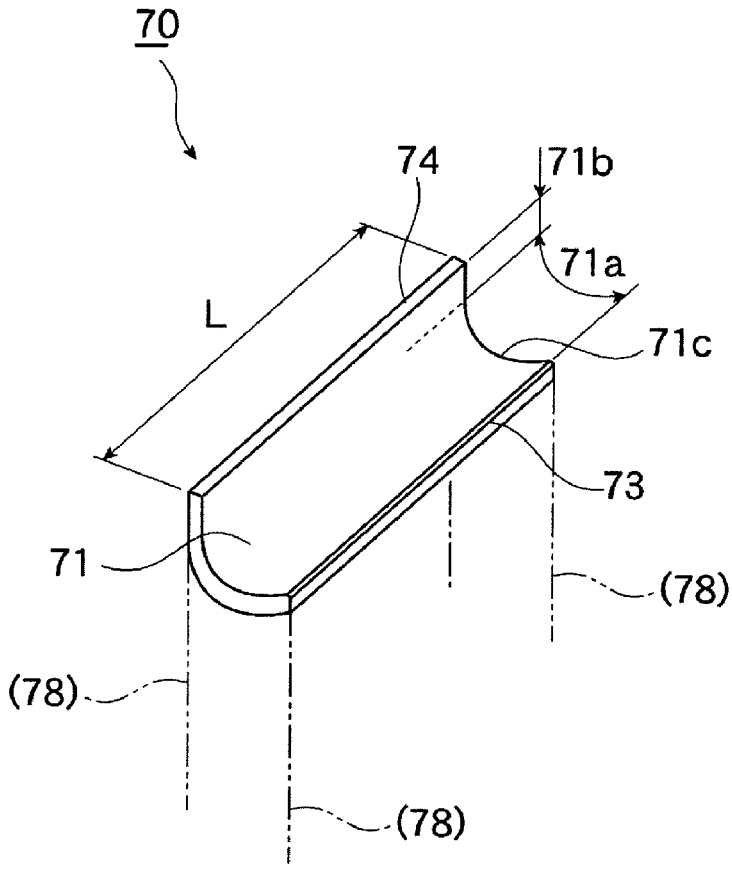
FIG. 12 is a perspective view showing other structural example of the movement assist member.

In the first exemplary embodiment, as the movement assist member 7, is shown a movement assist member (see FIG. 8) having the body part 72 formed in the lower part of the moving passage surface 71. However, a structural member having at least a moving passage surface 71 may be used. For instance, as shown by a full line in FIG. 12, a movement assist member 70 formed with a plate shaped structure having a moving passage surface 71 without a body part 72 may be employed.

When the plate shaped movement assist member 70 is employed, for instance, one end part in the longitudinal direction may be fixed to a wall surface of an end part of a main body part 52 of a container main body 50, so that the movement assist member may be attached and used in a cantilever state. Further, as shown by two-dot chain lines in FIG. 12, support legs 78 may be provided in the lower surface of the plate shaped movement assist member 70 and the movement assist member 70 may be provided in the accommodating space 51 of the main body part 52 of the container main body 50 through the support legs 78. In the movement assist member 70 or the movement assist member 70 having the support legs 78 provided, since a space part continuing to the accommodating space 51 of the container main body is ensured in the lower part of a moving passage surface 71, a developer Gc may be accommodated in the ensured space part and a quantity of accommodated developer may be increased.

Figure 13:
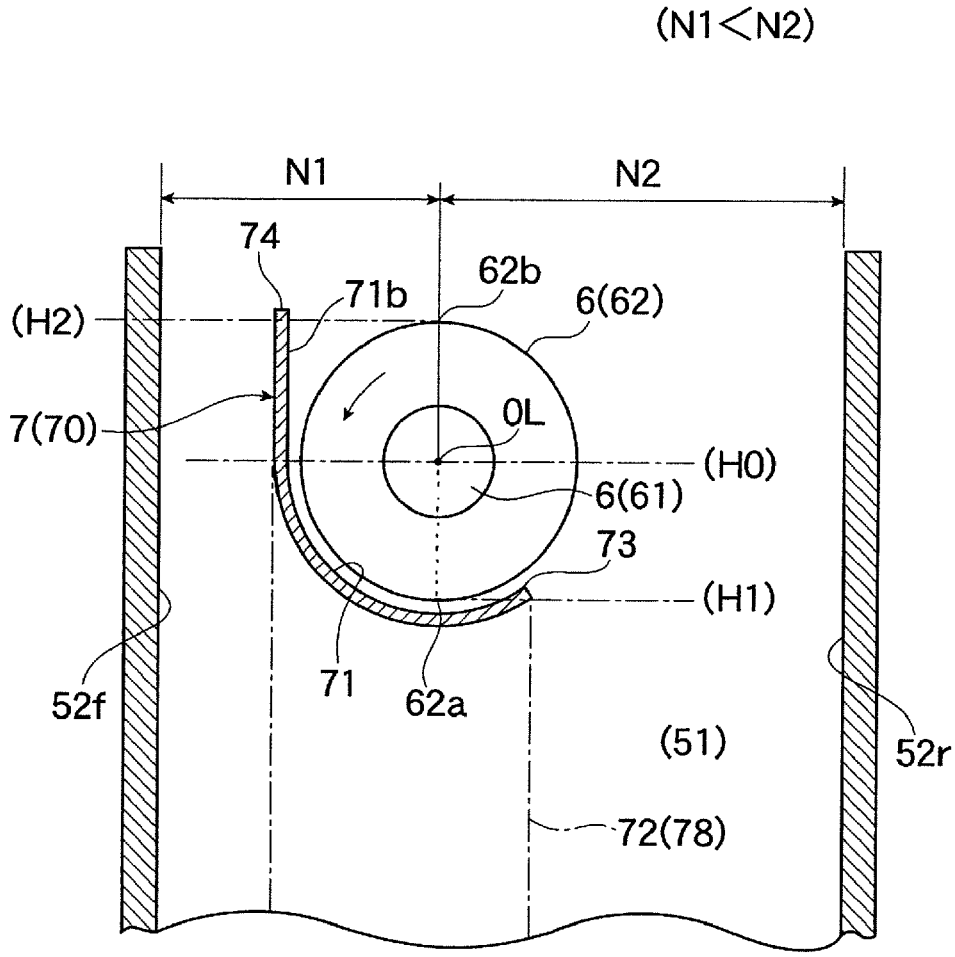
FIG. 13 is an explanatory view of main parts showing other structural example 1 of a moving passage surface of the movement assist member.

Further, as shown in FIG. 13, a relatively high upper end part 74 of a side surface in the movement assist member 7(70) may be formed with a height exceeding the height (H2) of an uppermost part 62*b* in a spiral vane 62 of an auger 6 during a rotation. In FIG. 13, distances N1 and N2 of opposed inner wall surfaces 52*f* and 52*r* separated from the central line OL of rotation of the auger 6 in the accommodating space 51 of the container main body 51 have a relation of "N1<N2".

When the upper end part 74 of the side surface is formed with such a height, the developer Gc dropping from a receiving port 54BT may be more received on the moving passage surface 71 side, and a rate of the developer dropping to the inner wall surface 52*f* side to which the upper end part 74 of the side surface is close may be reduced. Thus, a quantity of the developer Gc adhering to the inner wall surface 52*f* during the dropping process of the developer is reduced.

Further, when the auger 6 is provided under a state that the distances N1 and N2 of the inner wall surfaces 52*f* and 52*r* separated from the central line OL of rotation of the auger 6 are substantially equal (N1=N2), in the moving passage surface 71 of the movement assist member 7 (70), when the upper end parts 73 and 74 of the side surfaces are seen from an upstream side of a conveying direction M1 by the spiral vane 62 of the auger 6, the upper end part 74 of the side surface located in a side moving to a lower part from an upper part when the spiral vane 62 rotates is formed so as to be higher than the upper end part 73 of the other side surface.

When the moving passage surface is formed in such a way, the developer Gc may be moved by the moving passage surface 71 and a part of the developer Gc received by the moving passage surface 71 may be fed from the low upper end part 73 of the side surface by such a conveying force of the spiral vane 62 of the auger 6 as to take up the developer. Thus, the developer Gc does not remain nor adhere on the moving passage surface 71.

Figure 14:
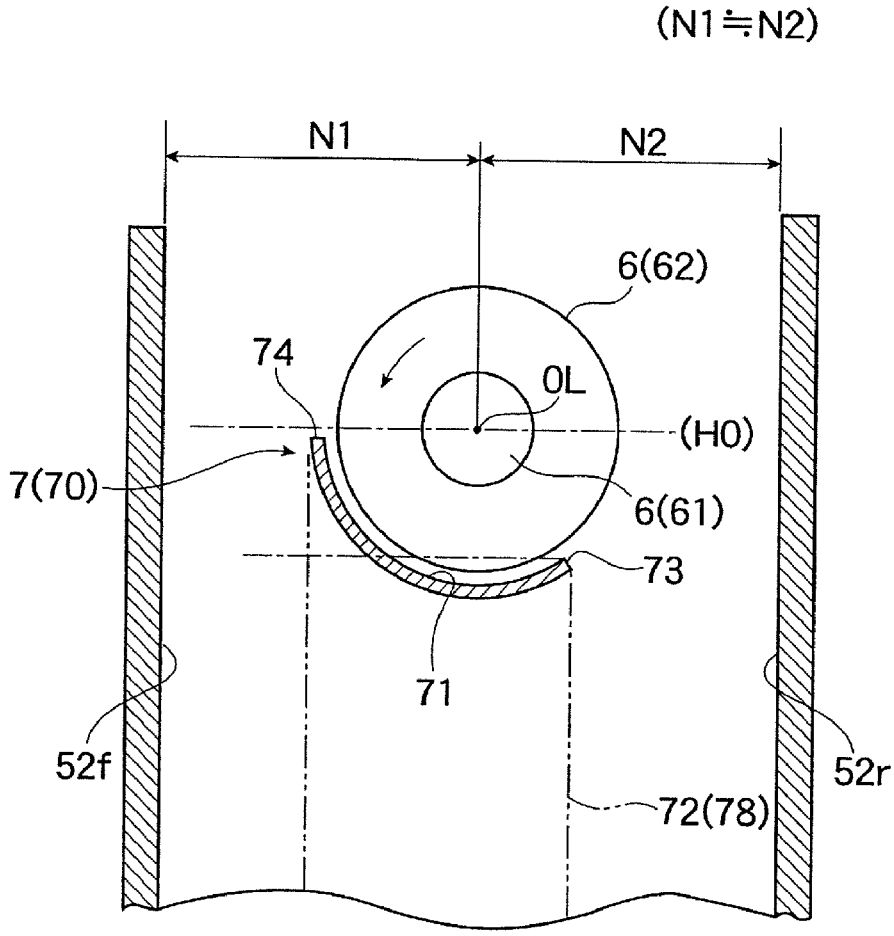
FIG. 14 is an explanatory view of main parts showing other structural example 2 of a moving passage surface of the movement assist member.

Further, in the case of the above-described structure, for the upper end part 74 of the side surface formed so as to be relatively high, as illustrated in FIG. 14, the upper end part 74 of the side surface may be formed with a height lower than the height (H0) of the central line OL of rotation of the auger 6. Thus, a quantity of the developer Gc received by the moving passage surface 71 is adjusted to be reduced so that the quantity of the developer moved through the moving passage surface 71 may be adjusted so as to be reduced. In the case of the above-described structure, the end part 74 of the side surface may be formed with a height not smaller than the height (H0) of the central line of rotation of the auger 6.

Figure 15:
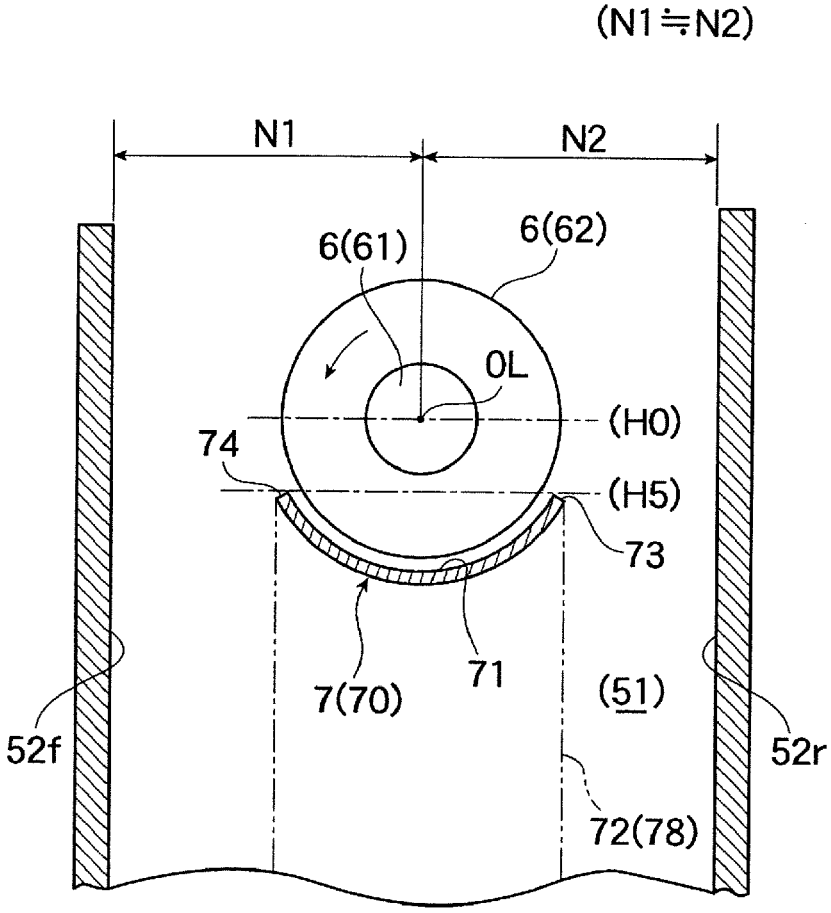
FIG. 15 is an explanatory view of main parts showing other structural example 3 of a moving passage surface of the movement assist member.

When the auger 6 is provided under a state that the distances N1 and N2 of the inner wall surfaces 52*f* and 52*r* separated from the central line OL of rotation of the auger 6 are substantially equal, for the moving passage surface 71 in the movement assist member 7 (70), as illustrated in FIG. 15, the upper end parts 73 and 74 of the side surfaces opposed to each other may be formed with substantially the same height (H5). In such a structure, the height (H5) of the upper end parts 73 and 74 of the side surfaces is set to at least a height lower than the height (H0) of the central line OL of rotation of the auger 6.

When the height of the upper end parts 73 and 74 of the side surfaces is set to the above-described height, a part of the developer dropping and received on the moving passage surface 71 may be advantageously dropped over the upper end parts 73 and 74 of the side surfaces during the moving process of the developer in spaces respectively provided between the upper end parts 73 and 74 of the side surfaces of the moving passage surface 71 and the inner wall surfaces 52*f* and 52*r*, distributed and conveyed in the longitudinal direction of the moving passage surface 71. When the height (H5) of the upper end parts 73 and 74 of the side surfaces at this time is the height (H0) of the central line OL of rotation of the auger 6 or higher, as the height is larger, a part of the developer is the more hardly dropped or cannot be dropped over the upper end parts 73 and 74 of the side surfaces of the moving passage surface 71 during the moving process of the developer. The developer cannot be distributed and conveyed on the moving passage surface 71 as described above.

Additionally, the recovery container 5 is exemplified that includes plural receiving ports. The recovery container having one receiving port formed may be employed. Further, in the recovery container 5, the connecting and conveying member and the conveying pipe of the connecting and conveying device 4 may be arranged so as to enter a part of the accommodating space 51 in the container and the developer to be recovered may be dropped and accommodated from a discharge port of the conveying pipe entering the accommodating space 51.

In the recovery container 5, in place of the auger 6 having the continuously spiral conveying vane 62 provided on the rotating shaft 61, other conveying member may be provided. As other conveying member, a coil shaped conveying member formed by winding a wire rod in a spiral form or a conveying member having a flat plate inclined with respect to a rotating shaft (a central line of rotation thereof) may be exemplified.

Further, in the developer recovery device 4, as the detector 42, in place of the light transmission type (an optical type) sensor, a detector of other system may be applied. For instance, a magnetic permeability sensor may be applied for detecting a quantity of accommodated developer by using the magnetic characteristics of a carrier of the developer. Further, the developer to be recovered to the recovery container 5 may be changed. For instance, the developer Gb may be discharged from the first leaning device 16 and the developer Ga may be discharged from the second cleaning device 26.

An image forming device 100 may include plural image creating units except four image creating units 110 as an image creating device 102. Further, in the image forming device 100, the creating device 102 may not use an intermediate transfer unit 120 as exemplified in the first exemplary embodiment.

Further, in the first exemplary embodiment, a case is exemplified in which the developer as a powder material is recovered to the recovery container 5, however, other powder material than the developer may be recovered.

The foregoing description of the exemplary embodiments of the present invention has been provided for the purpose of illustration and description. It is not intended to be exhaustive or to limit the invention to the precise forms disclosed. Obviously, many modifications and variations will be apparent to practitioners skilled in the art. The exemplary embodiments are chosen and described in order to best explain the principles of the invention and its practical applications, thereby enabling others skilled in the art to understand the invention for various exemplary embodiments and with the various modifications as are suited to the particular use contemplated. It is intended that the scope of the invention be defined by the following claims and their equivalents.

What is claimed is:

1. A powder material recovery container comprising:

a container main body that accommodates a powder material dropped therein;

a conveying member that is arranged so that at least one part thereof is disposed at least in an intermediate position of a dropping movement of the powder material in the container main body and rotates to convey the powder material, the conveying member having a conveying part that conveys the powder material around a central line of rotation; and a moving passage surface arranged in a lower part of the part disposed at least in the intermediate position of the dropping movement of the powder material of the conveying member in the container main body, and opposed to one part of the conveying member to receive a part of the dropping powder material and move the part of the powder material by a conveying force of the conveying member, wherein the moving passage surface has upper end parts of side surfaces opposed to each other with respect to the central line of rotation of the conveying member that are formed with relatively different heights, and the relatively lower upper end part of the side surface is formed with height not higher than a height of the central line of rotation.

2. The powder material recovery container according to claim 1, wherein the container main body has at least two inner wall surfaces opposed to each other with respect to the central line of rotation of the conveying member, formed with relatively different distances to the central line, and the relatively higher upper end part of the side surface is located in a side of the inner wall surface which is relatively closer to the central line.

3. The powder material recovery container according to claim 2, wherein in the moving passage surface, the relatively higher upper end part of the side surface is formed with a height not lower than the height of the central line of rotation of the conveying member.

4. The powder material recovery container according to claim 1, wherein in the moving passage surface, the upper end part of the side surface located in a side in which the conveying member moves downward from upward during the rotation of the conveying part of the conveying member when viewed from an upstream side of a conveying direction along the central line of rotation of the conveying member, is formed to be higher than the other upper end part of the side surface.

5. The powder material recovery container according to claim 4, wherein in the moving passage surface, the relatively higher upper end part of the side surface is formed with a height not lower than the height of the central line of rotation of the conveying member.

6. The powder material recovery container according to claim 1, wherein the conveying member includes a feed part that feeds the powder material in a direction orthogonal to the central line of rotation of the conveying member at least in a section opposed to the moving passage surface.

7. The powder material recovery container according to claim 1, wherein the container main body includes a plurality of receiving parts in which the powder material drops to be received, and the moving passage surface is provided in a lower part of a part of the conveying member existing at least in a lower part of the receiving part of the plurality of receiving parts whose quantity of conveyed powder material per unit time is maximum.

8. The powder material recovery container according to claim 1, wherein the powder material is a developer.

9. A powder material recovery device comprising:

a powder material recovery container including a container main body that accommodates a powder material dropped therein, a conveying member that is arranged so that at least one part thereof is disposed at least in an intermediate position of a dropping movement of the powder material in the container main body and rotates to convey the powder material, the conveying member having a conveying part that conveys the powder material around a central line of rotation, and a moving passage surface arranged in a lower part of the part disposed at least in the intermediate position of the dropping movement of the powder material of the conveying member in the container main body, and opposed to one part of the conveying member to receive a part of the dropping powder material and move the part of the powder material by a conveying force of the conveying member, wherein the moving passage surface has upper end parts of side surfaces opposed to each other with respect to the central line of rotation of the conveying member that are formed with relatively different heights, and the relatively lower upper end part of the side surface is formed with height not higher than a height of the central line of rotation;

a connecting and conveying device that connects a generating source of the powder material to be recovered to the powder material recovery container to the powder material recovery container and conveys the powder material;

a driving device that rotates the conveying member in the powder material recovery container; and a detector that detects the powder material accommodated and accumulated in the powder material recovery container.

10. The powder recovery device according to claim 9, wherein the container main body has at least two inner wall surfaces opposed to each other with respect to the central line of rotation of the conveying member, formed with relatively different distances to the central line, and the relatively higher upper end part of the side surface is located in a side of the inner wall surface which is relatively closer to the central line.

11. The powder recovery device according to claim 9, wherein in the moving passage surface of the powder material recovery container, the upper end part of the side surface located in a side in which the conveying member moves downward from upward during the rotation of the conveying part of the conveying member when viewed from an upstream side of a conveying direction along the central line of rotation of the conveying member, is formed to be higher than the other upper end part of the side surface.

12. The powder recovery device according to claim 9, wherein the conveying member of the powder material recovery container includes a feed part that feeds the powder material in a direction orthogonal to the central line of rotation of the conveying member at least in a section opposed to the moving passage surface.

13. The powder recovery device according to claim 9, wherein the container main body of the powder material recovery container includes a plurality of receiving parts in which the powder material drops to be received, and the moving passage surface is provided in a lower part of a part of the conveying member existing at least in a lower part of the receiving part of the plurality of receiving parts whose quantity of conveyed powder material per unit time is maximum.

14. The powder recovery device according to claim 9, wherein the powder material is a developer.

15. An image forming device comprising:

an image creating device that forms an image composed of a developer and transfers the image to a recording medium; and a developer recovery device that conveys a part of the developer used in the image creating device to a detachably exchanged developer recovery container to recover the developer, the developer recovery device including:

the developer recovery container including a container main body that accommodates the developer dropped therein, a conveying member that is arranged with a so that at least one part thereof is disposed at least in an intermediate position of a dropping movement of the developer in the container main body and rotates to convey the developer, the conveying member having a conveying part that conveys the developer around a central line of rotation, and a moving passage surface arranged in a lower part of the part disposed at least in the intermediate position of the dropping movement of the developer of the conveying member in the container main body, and opposed to one part of the conveying member to receive a part of the dropping developer and move the part of the developer by a conveying force of the conveying member, wherein the moving passage surface has upper end parts of side surfaces opposed to each other with respect to the central line of rotation of the conveying member that are formed with relatively different heights, and the relatively lower upper end part of the side surface is formed with height not higher than a height of the central line of rotation, a connecting and conveying device that connects a generating source of the developer to be recovered to the developer recovery container to the developer recovery container and conveys the developer, a driving device that rotates the conveying member in the developer recovery container, and a detector that detects the developer accommodated and accumulated in the developer recovery container.

16. The image forming device according to claim 15, wherein the container main body has at least two inner wall surfaces opposed to each other with respect to the central line of rotation of the conveying member, formed with relatively different distances to the central line, and the relatively higher upper end part of the side surface is located in a side of the inner wall surface which is relatively closer to the central line.

17. The image forming device according to claim 15, wherein in the moving passage surface of the powder material recovery container, the upper end part of the side surface located in a side in which the conveying member moves downward from upward during the rotation of the conveying part of the conveying member when viewed from an upstream side of a conveying direction along the central line of rotation of the conveying member, is formed to be higher than the other upper end part of the side surface.

18. The image forming device according to claim 15, wherein the conveying member of the powder material recovery container includes a feed part that feeds the developer in a direction orthogonal to the central line of rotation of the conveying member at least in a section opposed to the moving passage surface.

19. The image forming device according to claim 15, wherein the container main body of the powder material recovery container includes a plurality of receiving parts in which the developer drops to be received, and the moving passage surface is provided in a lower part of a part of the conveying member existing at least in a lower part of the receiving part of the plurality of receiving parts whose quantity of conveyed developer per unit time is maximum.

20. A powder material recovery container comprising:

a container main body that accommodates a powder material which is recovered and includes a cover part having a hole in which the powder material is passed;

a conveying member that is arranged below the hole in a vertical direction so as to overlap the hole in the vertical direction, including a conveying part which conveys the powder material around a central line of rotation of the conveying member and conveys the powder material by rotating the conveying member; and a moving passage surface formed to be opposed to at least between a top and a lowermost part of the conveying part in the vertical direction at a side that the conveying part moves downward from upward during rotating the conveying part, the moving passage surface overlapping one part of the conveying member at a lower side than the central line of rotation of the conveying member in the vertical direction without overlapping the conveying member at a higher side than the central line of rotation of the conveying member in the vertical direction, the moving passage surface having an end part of a side surface lower than the central line of rotation of the conveying member in the vertical direction.

21. The powder material recovery container according to claim 20, wherein the moving passage surface receives the powder material, and the conveying member conveys one part of the powder material along the central line of rotation of the conveying member on the moving passage, the one part of the powder material which falls down from the upper end part of the side surface.

22. The powder material recovery container according to claim 20, wherein a distance between an inner surface of the container main body at the side that the conveying part moves downward from upward during rotating the conveying part and the central line of rotation of the conveying member is similar than a distance between an inner surface of the container main body at a side that the conveying part moves upward from downward during rotating the conveying part and the central line of rotation of the conveying member.

* * * * *